US010589152B2

(12) United States Patent
Askenazi et al.

(10) Patent No.: US 10,589,152 B2
(45) Date of Patent: Mar. 17, 2020

(54) APPARATUS FOR COLLECTING AND STORING TENNIS BALLS

(71) Applicant: Sure Win, LLC, Denver, CO (US)

(72) Inventors: Barbara S. Askenazi, Denver, CO (US); David W. Roecker, Denver, CO (US)

(73) Assignee: SURE WIN, LLC, Denver, CO (US)

( * ) Notice: Subject to any disclaimer, the term of this patent is extended or adjusted under 35 U.S.C. 154(b) by 0 days.

(21) Appl. No.: 15/927,311

(22) Filed: Mar. 21, 2018

(65) Prior Publication Data

US 2018/0272197 A1 Sep. 27, 2018

Related U.S. Application Data

(63) Continuation-in-part of application No. 15/460,521, filed on Mar. 16, 2017, now abandoned.

(60) Provisional application No. 62/627,106, filed on Feb. 6, 2018, provisional application No. 62/425,542, filed on Nov. 22, 2016, provisional application No. 62/310,008, filed on Mar. 18, 2016.

(51) Int. Cl.

| | |
|---|---|
| ***A63B 47/02*** | (2006.01) |
| ***A63B 47/00*** | (2006.01) |
| *A63B 102/02* | (2015.01) |

(52) U.S. Cl.

CPC ..... *A63B 47/02* (2013.01); *A63B 47/002* (2013.01); *A63B 2102/02* (2015.10); *A63B 2225/682* (2013.01); *A63B 2225/685* (2013.01); *A63B 2225/687* (2013.01); *A63B 2225/72* (2013.01)

(58) Field of Classification Search

CPC ..... A63B 47/00–2047/028; B65G 39/00–02; B65G 17/12; F16G 3/06

USPC ..... 473/460; 414/441; 198/690.2, 698, 198/699.1, 711, 844.2

See application file for complete search history.

(56) References Cited

U.S. PATENT DOCUMENTS

| | | | | |
|---|---|---|---|---|
| 1,650,796 A | | 3/1924 | Kellogg | |
| 2,313,406 A | | 3/1943 | Walker | |
| 2,321,387 A | | 6/1943 | Jackson | |
| 2,326,165 A | * | 8/1943 | Pelosi ..... | B65G 19/282 198/629 |

(Continued)

FOREIGN PATENT DOCUMENTS

| | | |
|---|---|---|
| CA | 2357678 A1 | 3/2003 |
| CH | 662058 A5 | 9/1987 |

(Continued)

OTHER PUBLICATIONS

English machine translation of FR 2,574,302 A1.*

(Continued)

*Primary Examiner* — Laura Davison

(74) *Attorney, Agent, or Firm* — Lewis Brisbois Bisgaard & Smith LLP; Craig W. Mueller

(57) ABSTRACT

A ball collecting apparatus is provided that employs a human-powered ball transport system that moves balls from a collecting surface to a location above the collection surface. The ball collecting apparatus employs no motors or other artificially powered devices to retrieve and transfer balls, which makes it light and easy to maneuver. The ball collecting apparatus is primarily contemplated for use of picking up tennis balls, but other balls of various sizes may be accommodated by the apparatus, as it is scalable.

5 Claims, 19 Drawing Sheets

(56) References Cited

U.S. PATENT DOCUMENTS

| | | | | |
|---|---|---|---|---|
| 2,658,637 | A | 9/1949 | Bailey | |
| 3,102,647 | A | 9/1963 | Bonney | |
| 3,485,398 | A | 12/1969 | Offner | |
| 3,520,727 | A | 7/1970 | Crump | |
| 3,593,868 | A | 7/1971 | Folz | |
| 3,595,000 | A | 7/1971 | Recker | |
| 3,777,732 | A | 12/1973 | Holloway et al. | |
| 3,823,838 | A | 7/1974 | Gustafson et al. | |
| 3,856,165 | A | 12/1974 | Gustafson | |
| 3,888,370 | A | 6/1975 | Gamblin | |
| 3,913,552 | A | 10/1975 | Yarur et al. | |
| 3,986,324 | A | 10/1976 | Harriott et al. | |
| 4,077,533 | A | 3/1978 | Meyer | |
| 4,112,911 | A | 9/1978 | Petrick | |
| 4,116,192 | A | 9/1978 | Scott | |
| 4,221,524 | A | 9/1980 | Morris | |
| 4,252,490 | A | 2/1981 | Keller | |
| 4,318,654 | A | 3/1982 | Lee | |
| 4,383,695 | A | 5/1983 | Ray | |
| 4,461,504 | A | 7/1984 | Perez et al. | |
| 4,550,465 | A | 11/1985 | Chrisley | |
| 4,593,519 | A | 6/1986 | Kimball | |
| 4,596,414 | A | 6/1986 | Mottet | |
| 4,721,428 | A | 1/1988 | Rohrer et al. | |
| 4,735,544 | A | 4/1988 | Stotts | |
| 4,844,527 | A | 7/1989 | Ray | |
| 5,056,786 | A | 10/1991 | Bellettini et al. | |
| 5,125,654 | A | 6/1992 | Bruno | |
| 5,147,100 | A | 9/1992 | Frankel | |
| 5,149,245 | A | 9/1992 | Landmann | |
| 5,294,161 | A * | 3/1994 | Stap | A63B 47/02 294/19.2 |
| 5,301,991 | A | 4/1994 | Chen et al. | |
| 5,368,351 | A | 11/1994 | Cuti | |
| 5,407,242 | A | 4/1995 | Beranek | |
| 5,464,262 | A | 11/1995 | Madrazo | |
| 5,507,541 | A | 4/1996 | Chen et al. | |
| 5,527,075 | A | 6/1996 | Jones et al. | |
| 5,979,639 | A * | 11/1999 | Sytema | B65G 17/42 198/731 |
| 6,079,930 | A | 6/2000 | Valdes-Rodriguez | |
| 6,142,544 | A | 11/2000 | Benzoni et al. | |
| 6,340,188 | B1 | 1/2002 | Cuti | |
| D454,607 | S | 3/2002 | Cuti | |
| 6,513,845 | B2 | 2/2003 | Campomane | |
| 6,834,776 | B1 | 12/2004 | Corvese | |
| 6,883,844 | B2 | 4/2005 | Carr | |
| 7,306,097 | B2 | 12/2007 | Wohlwender | |
| 7,341,294 | B2 | 3/2008 | Olmstead | |
| 7,674,196 | B2 | 3/2010 | Tsai | |
| 8,056,177 | B2 | 11/2011 | Hammad | |
| 8,075,030 | B2 | 12/2011 | Pearson et al. | |
| 8,132,836 | B2 | 4/2012 | Chen | |
| 8,177,271 | B2 | 5/2012 | Zats | |
| 8,297,669 | B2 | 10/2012 | Matthews | |
| 8,313,396 | B1 | 11/2012 | Mailman | |
| 8,556,565 | B2 | 10/2013 | Reyes | |
| 8,602,711 | B1 | 12/2013 | Nash et al. | |
| 8,920,101 | B2 | 12/2014 | Leyco et al. | |
| 2006/0068948 | A1 | 3/2006 | Mendoza | |
| 2006/0082171 | A1 | 4/2006 | Olmstead | |
| 2010/0193379 | A1 | 8/2010 | Matthews | |
| 2011/0262259 | A1 | 10/2011 | Zats | |
| 2011/0275414 | A1 | 11/2011 | Pegg | |
| 2012/0093621 | A1 | 4/2012 | Reyes | |
| 2013/0064631 | A1 | 3/2013 | Leyco et al. | |
| 2014/0294547 | A1 | 10/2014 | Guo et al. | |
| 2014/0356114 | A1 | 12/2014 | Budacsek | |

FOREIGN PATENT DOCUMENTS

| | | | | |
|---|---|---|---|---|
| CN | 2017600700 | U | 3/2011 | |
| CN | 103212191 | A | 7/2013 | |
| DE | 3144970 | A1 | 5/1983 | |
| DE | 3934490 | A1 | 4/1991 | |
| DE | 4218085 | A1 * | 12/1993 | A63B 47/021 |
| DE | 19715886 | A1 | 4/1997 | |
| DE | 20110742 | U1 | 12/2001 | |
| DE | 102009032561 | A1 | 1/2011 | |
| EP | 1878474 | A1 | 1/2008 | |
| FR | 2510415 | A1 | 7/1981 | |
| FR | 2555455 | A1 | 11/1983 | |
| FR | 2558380 | A1 | 1/1984 | |
| FR | 2574302 | A1 | 12/1984 | |
| FR | 2574670 | A1 | 12/1984 | |
| FR | 2574302 | A1 * | 6/1986 | A63B 37/021 |
| GB | 868230 | A1 | 1/1959 | |
| GB | 1555265 | | 11/1979 | |
| JP | 200424343 | | 1/2004 | |
| WO | 8603419 | A1 | 6/1986 | |
| WO | 2006001678 | A1 | 1/2006 | |

OTHER PUBLICATIONS

English machine translation of DE 4218085 A1.*

Non-final office action dated Jan. 12, 2018 from parent U.S. Appl. No. 15/460,521. 18 Pages.

* cited by examiner

APPARATUS FOR COLLECTING AND STORING TENNIS BALLS

This application claims the benefit of U.S. Provisional Patent Application Ser. No. 62/627,106, filed Feb. 6, 2018, the entirety of which is incorporated by reference herein.

This application is also a continuation-in-part of U.S. patent application Ser. No. 15/460,521, filed Mar. 16, 2017, which claims the benefit of U.S. Provisional Patent Application Ser. No. 62/425,542, filed Nov. 22, 2016, and U.S. Provisional Patent Application Ser. No. 62/310,008, filed Mar. 18, 2016, the entire disclosures of which are incorporated by reference herein.

FIELD OF THE INVENTION

Embodiments of the present invention are generally related to an apparatus that gathers balls and moves them to an easy-to-access location, thereby eliminating the need to manually transfer balls from one basket to another.

BACKGROUND OF THE INVENTION

Tennis is a very popular game world-wide. Indeed, many tennis novices take lessons to increase their proficiency. Lessons comprise practicing skills necessary to perform at a higher level and often entail the student hitting many tennis balls against the wall or returning them to instructor or fellow students across a net. Two common pieces of equipment assist instructors and players.

The first piece of equipment is an instructor teaching cart, which can hold approximately 350 tennis balls at waist level. During a lesson, an instructor or student repeatedly reaches into the teaching cart to access balls. Traditional teaching carts can move longitudinally and laterally on four wheels, which allows the instructor or player to easily maneuver the cart to different areas of the tennis court.

The second piece of equipment is a tennis ball mower that retrieves balls from the court that are later moved to the teaching cart, ball machine, or smaller ball baskets. The alternative to using a mower is to hand-pick each ball from the tennis court. Tennis ball mowers are usually large and bulky, and take up valuable space on the tennis court. The traditional tennis ball mowers collect the balls in a basket at ground level, requiring someone to manually transfer the basket of balls into another storage area. This task is inefficient and awkward.

The following describes a tennis ball collecting apparatus that does not rely on an outside power source, that is very maneuverable, and that efficiently collects the balls and sends them automatically to a waist-level storage basket, thereby offering easy access to the balls without having to manually transfer the balls.

SUMMARY OF THE INVENTION

It is one aspect of some embodiments of the present invention to provide a ball collecting apparatus that has the functionality of the ball mower and a ball delivery device, commonly known as an instructor ball cart. The apparatus contemplated by some embodiments of the present invention collects tennis balls and moves them from the ground to a second location above the ground, which makes the balls easy to access without the user having to bend over. In addition, unlike ball mowers of the prior art, the ball collecting apparatus of one embodiment does not rely on motorized devices for propulsion or to transfer collected balls from the ground to a storage location. Although this disclosure concentrates primarily on tennis balls, one of ordinary skill the art will appreciate the ball collecting apparatus and components thereof described herein can be modified to collect any type of ball, such as golf balls, basketballs, baseballs, softballs, ping-pong balls, etc., without departing from the scope of the invention.

It is another aspect of some embodiments of the present invention to provide a ball collecting apparatus that can move longitudinally and laterally. More specifically, after the balls are moved to the elevated storage position, it is desirous to be able to move the apparatus longitudinally (i.e., forward and backward) and laterally (i.e., side to side). This mobility allows the instructor or tennis player to quickly move the apparatus to a desired location on the tennis court.

It is yet another aspect of some embodiments of the present invention to provide a ball collecting apparatus that relies solely on human power to operate. The absence of batteries, motors, and other complex machinery, allows the ball collecting device to be light and maneuverable. Additionally, the absence of an outside power source is more efficient as there is no need to charge batteries or connect to a power source. The ball collecting apparatus can operate indoors and outdoors without requiring a power source or an electrical cord, which may present a dangerous obstacle on the tennis court. The ball collecting device of one embodiment employs a plurality of wheels that allow it to be easily moved. Forward movement activates a ball transport system that engages at least one ball, moves the ball into the apparatus, and lifts the ball into the storage location. For example, the storage location may be a basket positioned above the ground that is more accessible to the user. An integrated ball storage location also avoids having to manually transfer/empty the collected balls into a second instructor cart. Conversely, current methods require collecting balls at ground level with tennis ball mowers, hand-held baskets, collection tubes, etc. and, thereafter, manually transferring the collected balls to other equipment, such as tennis ball instructor carts, where they are used for instruction and practice.

It is a related aspect of some embodiments of the present invention to provide a removable basket that receives collected tennis balls. The removable basket may be interconnected to the ball collecting apparatus, wherein the balls are collected and deposited in the basket at an elevated level. In this mode of use, the ball collecting apparatus doubles as an instructional cart. In another mode of use, the basket is removed and moved to a different location on the court.

The basket of one embodiment of the present invention includes handles. The handles may be rotated relative to each other such that the upper portions normally used for carrying the basket are transformed into feet that are placed on the playing surface. The length of the handles will dictate the elevation of the basket when the handles are rotated into their second position of use. Ideally, handles are elongated such that the basket is positioned at or near waist level. The handles may telescope such that when used in the first mode of use (i.e., ball collecting), they are shorter than when they are in the second mode of use (i.e., practice configuration). Some ball collecting devices employ multiple locations for storing more than one basket; once a first basket is full, it is replaced with an empty basket. In this example, both baskets can be interconnected to the ball collecting device.

Some embodiments of the present invention comprise a housing having a left panel, right panel, a front panel, and a rear panel that envelope the ball transport system. The front panel has a bottom opening configured to receive at least one ball, and an upper opening associated with the ball storage location, e.g., the basket. In operation, the ball transport system moves balls received in the lower opening to the upper opening. Some embodiments of the present invention include arms adjacent to lateral edges of the lower opening that help corral the balls into the lower opening. The arms may be fixed to the left and right panels or selectively interconnected thereto to facilitate storage. In some other versions, the arms are selectively deployable and capable of moving so they do not adversely affect mobility during instruction.

The ball transport system of one embodiment of the present invention employs upper and lower pulleys that operatively interconnect to a belt. The lower pulley is also operatively interconnected to primary wheels that support the ball collecting apparatus. The lower pulley rotates as the wheels rotate forward, wherein movement of the ball collecting apparatus in the forward direction moves a portion of the belt from a location near the bottom opening of the front panel to a location near the upper opening of the front panel. Movement of the wheels in the opposite direction, however, will not rotate the lower pulley so the belt can only move one way. The rear panel may be removable to address ball jam issues, if necessary. The belt also accommodates a plurality of ball transport members that engage balls and help transport them to the upper opening of the front panel. In one embodiment of the present invention, the belt is made from a plurality of segments, which will be further discussed below.

It is another aspect of some embodiments of the present invention to provide a ball collecting apparatus that is durable, weatherproof, and which includes built-in ergonomic features. For example, some embodiments employ a recess in an upper portion thereof adapted to receive a water bottle or cell phone. In addition, the upper portion may be configured to receive a tablet computer or a chalkboard. In addition, a dry erase board may be included on the upper portion to be used for instruction along with magnets or dry erase markers, for example. The upper portion may also employ a door that conceals additional storage compartments. The door may provide selective access to the inside of the apparatus to clear ball jams if needed. Furthermore, some embodiments of the present invention provide hooks for towels, jackets, and tennis rackets.

It is yet another aspect of some embodiment of the present invention to provide a security mechanism associated with ball storage areas employed by the apparatus. More specifically, the apparatus may be adapted to receive a weatherproof, lockable cover that restricts access to stored balls.

It is still yet another aspect of some embodiments of the present invention to provide a ball collecting apparatus that can also direct, i.e., launch collected balls. For example, collected tennis balls are selectively taken from the storage location, either automatically or manually, and fed to a tennis ball launcher.

It is another aspect of embodiments of the present invention to provide an apparatus for collecting at least one ball comprising: a left panel; a right panel spaced from the left panel; a rear panel interconnected to a rear edge of the left panel and a rear edge of the right panel; a front panel interconnected to a front edge of the left panel and a front edge of the right panel, the front panel having a lower edge spaced from a lower edge of the left and right panel to provide a lower opening, and wherein the front panel has an upper edge spaced from an upper edge of the left panel and an upper edge of the right panel; an upper axle interconnected between the left panel to the right panel adjacent to an upper portion of the apparatus; a first pulley rotatably interconnected to the upper axle; a lower axle having a first end and a second end interconnected between the left panel to the right panel adjacent to a lower portion of the apparatus; a second pulley rotatably interconnected to the lower axle; a right wheel positioned adjacent to the right panel, the right wheel interconnected to the first end of the lower axle; a left wheel positioned adjacent to the left panel, the left wheel interconnected to the second end of the lower axle; wherein rotation of at least one of the left wheel or the right wheel rotates the lower pulley; a belt having an inner surface that operatively engages an outer surface of the first pulley and the second pulley, wherein rotation of the lower pulley moves the belt around the first pulley and the second pulley; at least one ball transferring member extending from an outer surface of the belt; and wherein the lower opening is adapted to receive at least one ball that is engaged by the at least one ball transferring member that moves the at least one ball from the lower opening to the upper opening as the apparatus is moved forward.

It is another aspect of embodiments of the present invention to provide an apparatus for collecting at least one ball comprising: a housing having a left side, a right side, a front side, and a back side, the front side having a lower opening and an upper opening; an upper axle interconnected between the left side to the right side adjacent to an upper portion of the apparatus; a first pulley rotatably interconnected to the upper axle; a lower axle having a first end and a second end interconnected between the left side to the right side adjacent to a lower portion of the apparatus; a second pulley rotatably interconnected to the lower axle; a right wheel positioned adjacent to the right side, the right wheel interconnected to the first end of the lower axle; a left wheel positioned adjacent to the left side, the left wheel interconnected to the second end of the lower axle; wherein rotation of at least one of the left wheel or the right wheel rotates the lower pulley; a belt having an inner surface that operatively engages an outer surface of the first pulley and the second pulley, wherein rotation of the lower pulley moves the belt around the first pulley and the second pulley; and a means for transferring a ball extending from an outer surface of the belt.

It is yet another aspect of embodiments of the present invention to provide a method of retrieving balls from a surface and depositing the balls to a basket, comprising: providing a ball transport system comprising a segmented belt having a plurality of ball lifting members extending therefrom; providing a ball scoop that cooperates with the ball lifting members from a horizontal plane to a vertical plane; providing a ball guide that facilitates movement of balls from the surface to the ball scoop; directing balls to the ball lifting members through the ball guide; moving the balls to the ball scoop; positioning the balls on a curved upper surface of the ball lifting members; moving the balls upwardly; and depositing the balls in a location positioned above the surface It is another aspect of the embodiments of the present invention to provide a recessed area on either side of the invention which may be used to secure club logos and/or advertisements.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
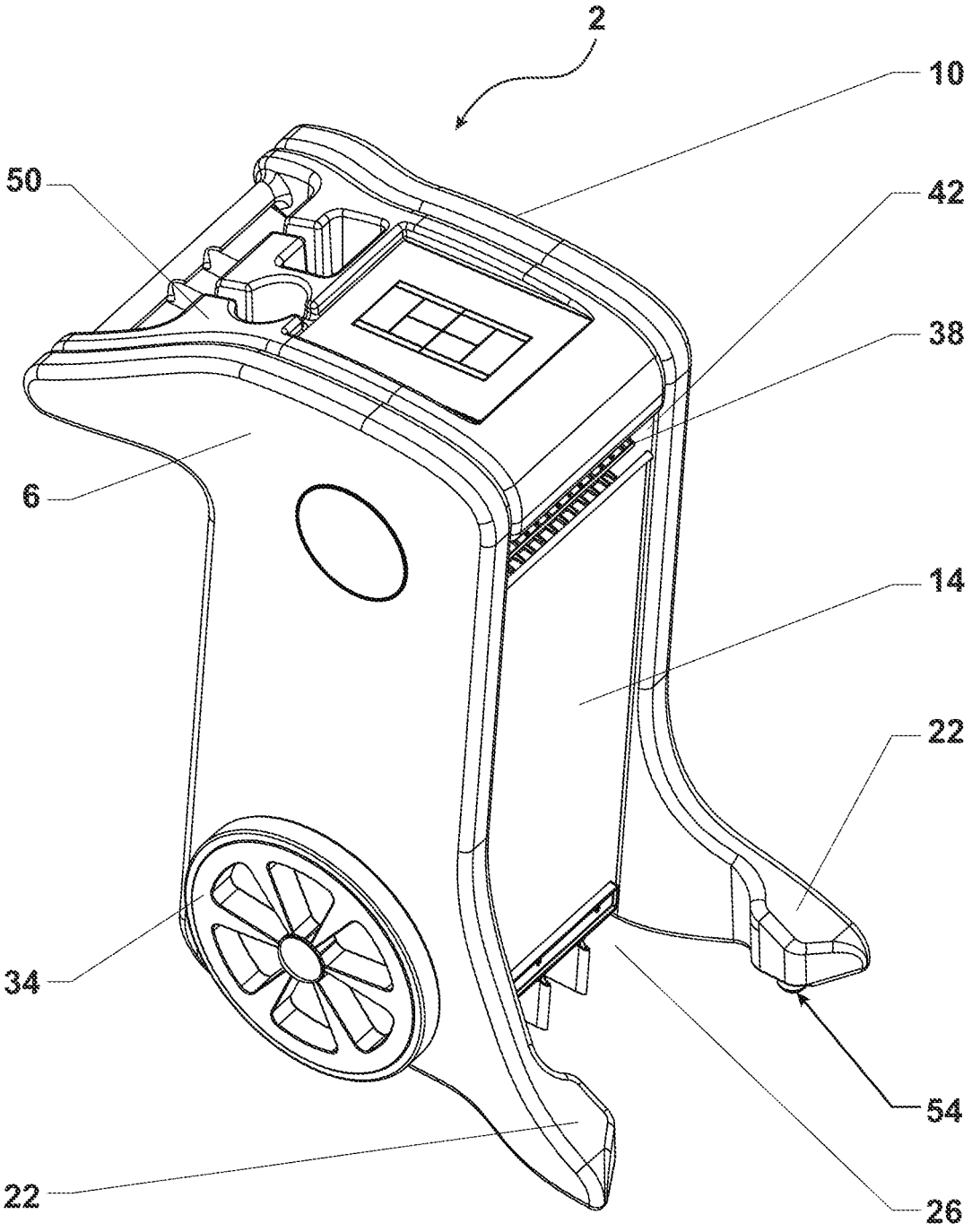
FIG. 1 is a front perspective view of the ball collecting apparatus of one embodiment of the present invention.
Figure 2:
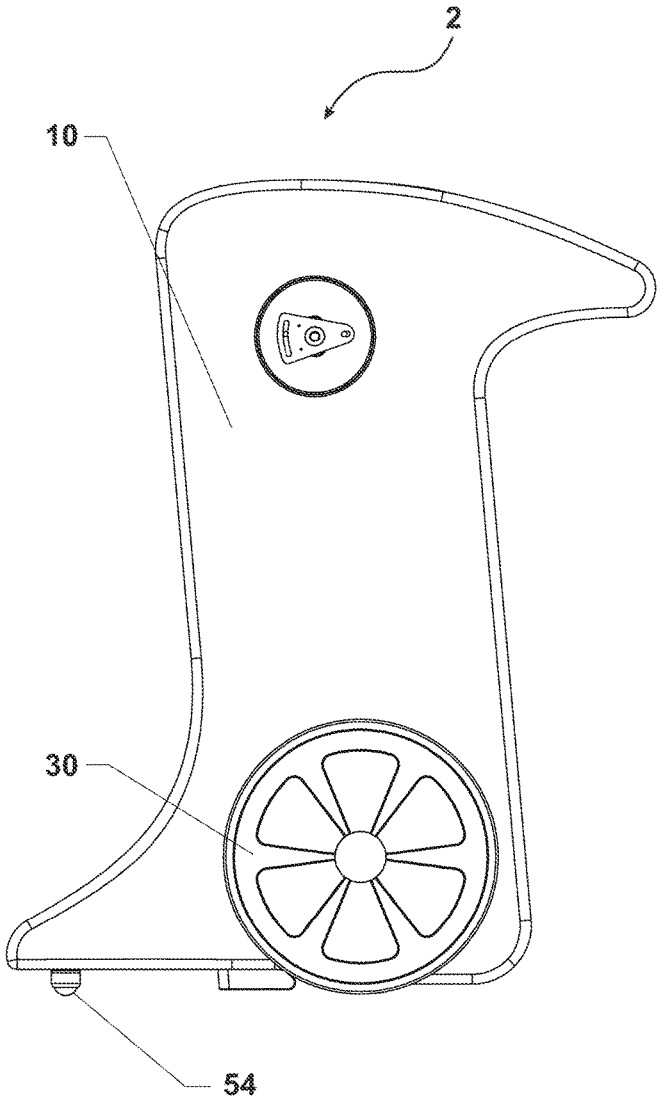
FIG. 2 is a right elevation view of the ball collecting apparatus shown FIG. 1.
Figure 3:
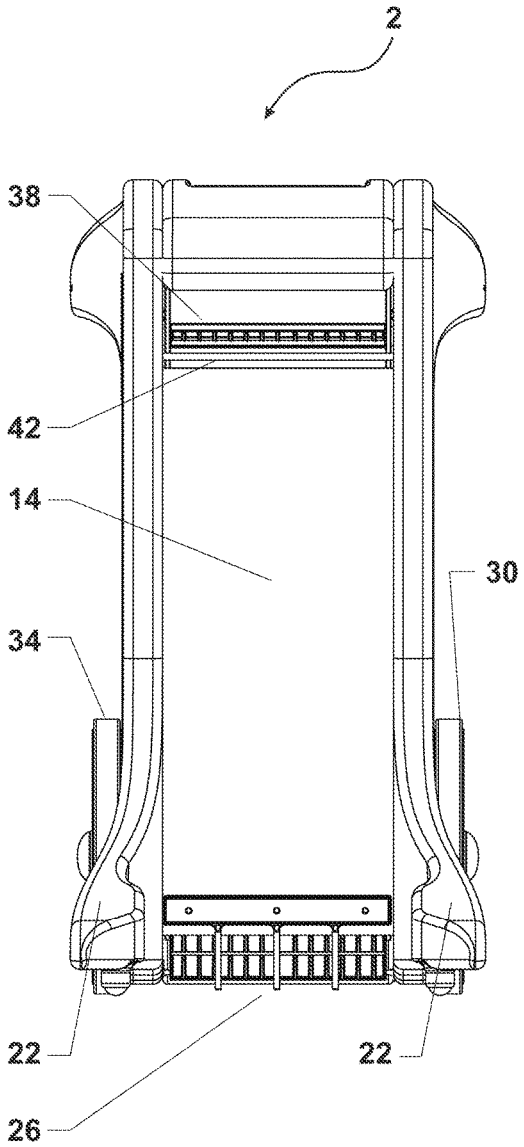
FIG. 3 is a front elevation view of the ball collecting apparatus shown in FIG. 1.
Figure 4:
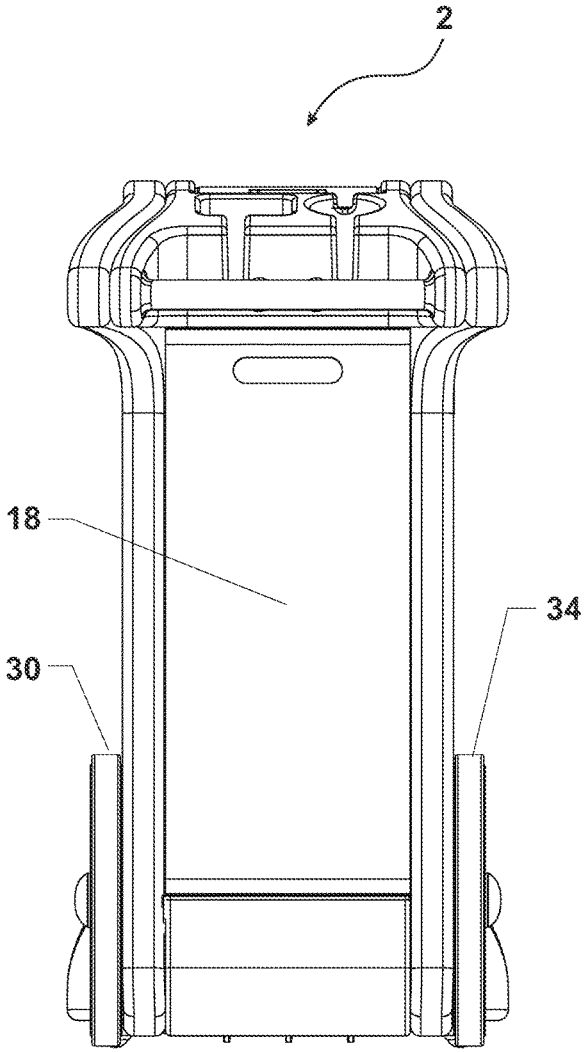
FIG. 4 is a rear elevation view of the ball collecting apparatus shown in FIG. 1.
Figure 5:
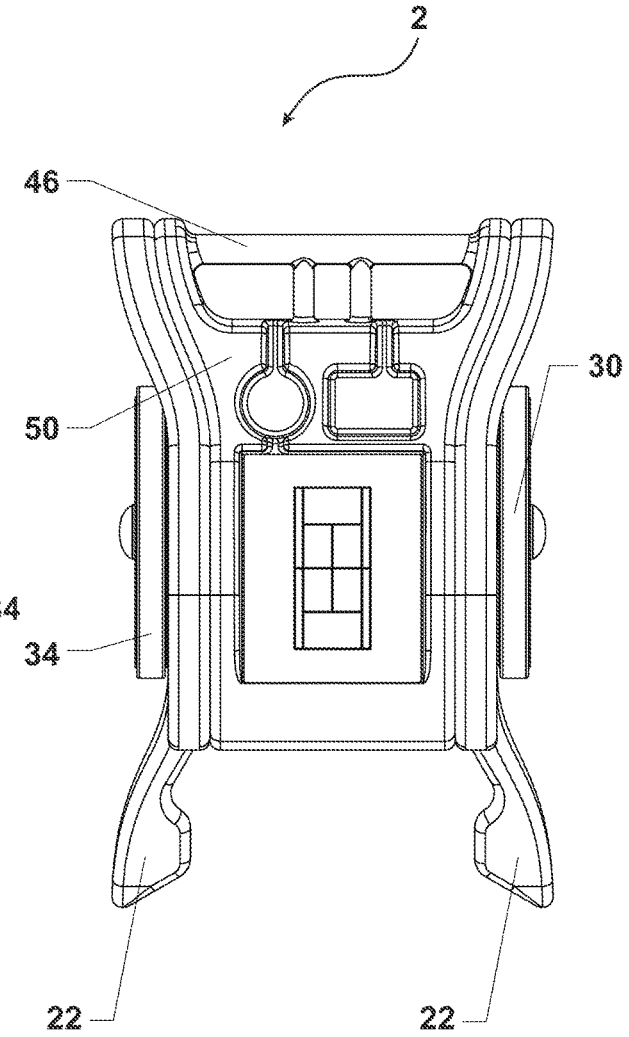
FIG. 5 is a top plan view of the ball collecting device apparatus shown in FIG. 1

To assist in the understanding of one embodiment of the present invention the following list of components and associated numbering found in the drawings is provided herein:

| # | Component |
|---|---|
| 2 | Ball collecting apparatus |
| 6 | Right panel |
| 10 | Left panel |
| 14 | Front panel |
| 18 | Rear panel |
| 22 | Extension |
| 26 | Lower opening |
| 30 | Left wheel |
| 34 | Right wheel |
| 38 | Ball transport system |
| 42 | Upper opening |
| 46 | Handle |
| 50 | Upper tray |
| 54 | Coaster rollers |
| 58 | Basket |
| 62 | Basket support rod |
| 66 | Lower edge |
| 70 | Upper edge |
| 74 | Hooked lip |
| 86 | First handle |
| 90 | Second handle |
| 94 | Hub |
| 98 | Lower lock |
| 102 | First leg |
| 106 | Second leg |
| 110 | Upper lock |
| 200 | Upper pulley |
| 204 | Lower pulley |
| 206 | Freewheel needle bearing |
| 208 | Belt |
| 212 | Plate |
| 216 | Upper axle |
| 220 | Lower axle |
| 228 | Ridges |
| 232 | Teeth |
| 240 | Belt segment |
| 244 | Tab |
| 250 | Ball guide |
| 254 | Bar |
| 300 | Ball scoop |
| 304 | Leading edge |
| 308 | Roller |
| 400 | Ball transport member |
| 400 | Curved end |
| 404 | Upper surface |
| 408 | Rib |
| 412 | Channel |
| 416 | Feet |
| 500 | Ball |
| 504 | Turnstile |
| 508 | Turnstile shaft |
| 512 | First timing gear |
| 516 | Second timing gear |

-continued

| # | Component |
|---|---|
| 520 | Timing belt |
| 524 | Channel |
| 528 | Key groove |
| 532 | Arm |
| 536 | Hub |
| 540 | Wall |
| 544 | Tip |
| 548 | Inner surface |
| 552 | Roller |
| 556 | Surface |

It should be understood the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIGS. 1-17 show a ball collecting apparatus 2 of one embodiment of the present invention and components thereof. More specifically, FIGS. 1-5 show a ball collecting apparatus comprising a right panel 6, left panel 10, a front panel 14 and a rear panel 18. The right panel 6 and left panel 10 include extensions 22 (also referred to as "arms") that direct balls into a lower opening 26 of the front panel 14 as the ball collecting apparatus 2 is moved forward. The ball collecting apparatus 2 also includes a left wheel 30 and a right wheel 34 that maintain a space between an underside portion of the ball collecting apparatus 2 and a collection surface, e.g., a tennis court. The ball collecting apparatus 2 employs a ball transport system 38 that is operably interconnected to the left or right wheel assembly such that when the left or right wheel is rotated, the transport system 38 moves in such a way to transport balls from the ball collection surface through an upper opening 42 provided in the front panel 14.

In operation, the user grasps a handle 46 associated with an upper tray 50 of the ball collecting apparatus 2 and pushes forward. Propulsion is provided by human energy, facilitated by the left or right wheels provided on each side of the ball collecting apparatus. The extensions 22 are supported by caster rollers 54 at their distal ends. Accordingly, the ball collecting apparatus 2 is supported by wheels adapted to move in generally one direction (forward and backward), and to rollers adapted to move in multiple directions that allow the apparatus to be stable and maneuverable.

In operation, the user moves the ball collecting apparatus 2 forward towards one or more balls on a surface. Moving the ball collecting apparatus 2 forward causes the left wheel 30 and right wheel 34 to rotate, which imparts a rotation on internal componentry that moves the ball transport system 38. Balls gathered by the extensions 22 are channeled towards the lower opening 26 of the front panel 14, selectively captured by the transport system, moved to the upper opening 42 of the front panel, and are deposited in a ball storage location, e.g., a basket.

The ball collecting apparatus of one embodiment of the present invention is approximately 40 inches tall, by 22.5 inches wide. The distance between the handle 46, approximately the extreme rear of the ball collecting apparatus, and the tips of the extensions 22 in one embodiment of the present invention is about 37.5 inches. Further, the ball collecting apparatus of one embodiment of the present invention weighs about 130 pounds and, thus, is easy to maneuver. The decreased weight savings is achieved by omitting the use of heavy motors or other drive devices. Furthermore, components of one embodiment of the present invention are made of lightweight materials such as linear low-density polyethylene (LLDPE).

One of ordinary skill the art will appreciate that the dimensions of the ball collecting apparatus disclosed herein may be selectively altered to fit the collection needs. For example, the wheels of a baseball collecting apparatus may need to be altered to accommodate grass or AstroTurf which are rougher than a tennis court. Furthermore, for some collection scenarios a motor may be needed to help the user propel the apparatus across a bumpy or inconsistent terrain.

Figure 7:
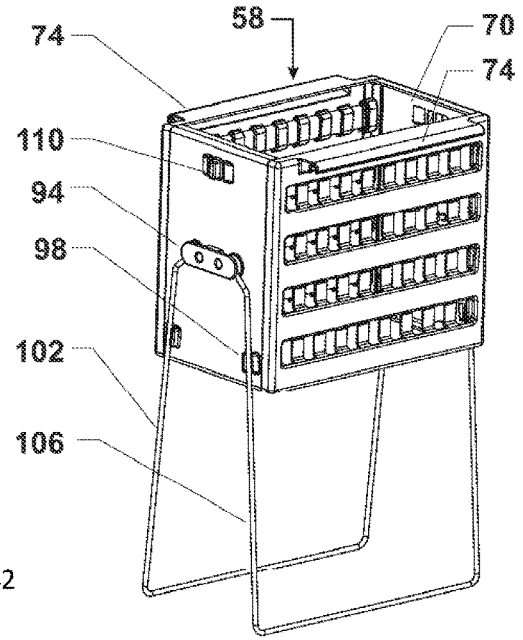
FIG. 7 is the basket shown in FIG. 6 in a second configuration of use.
Figure 6:
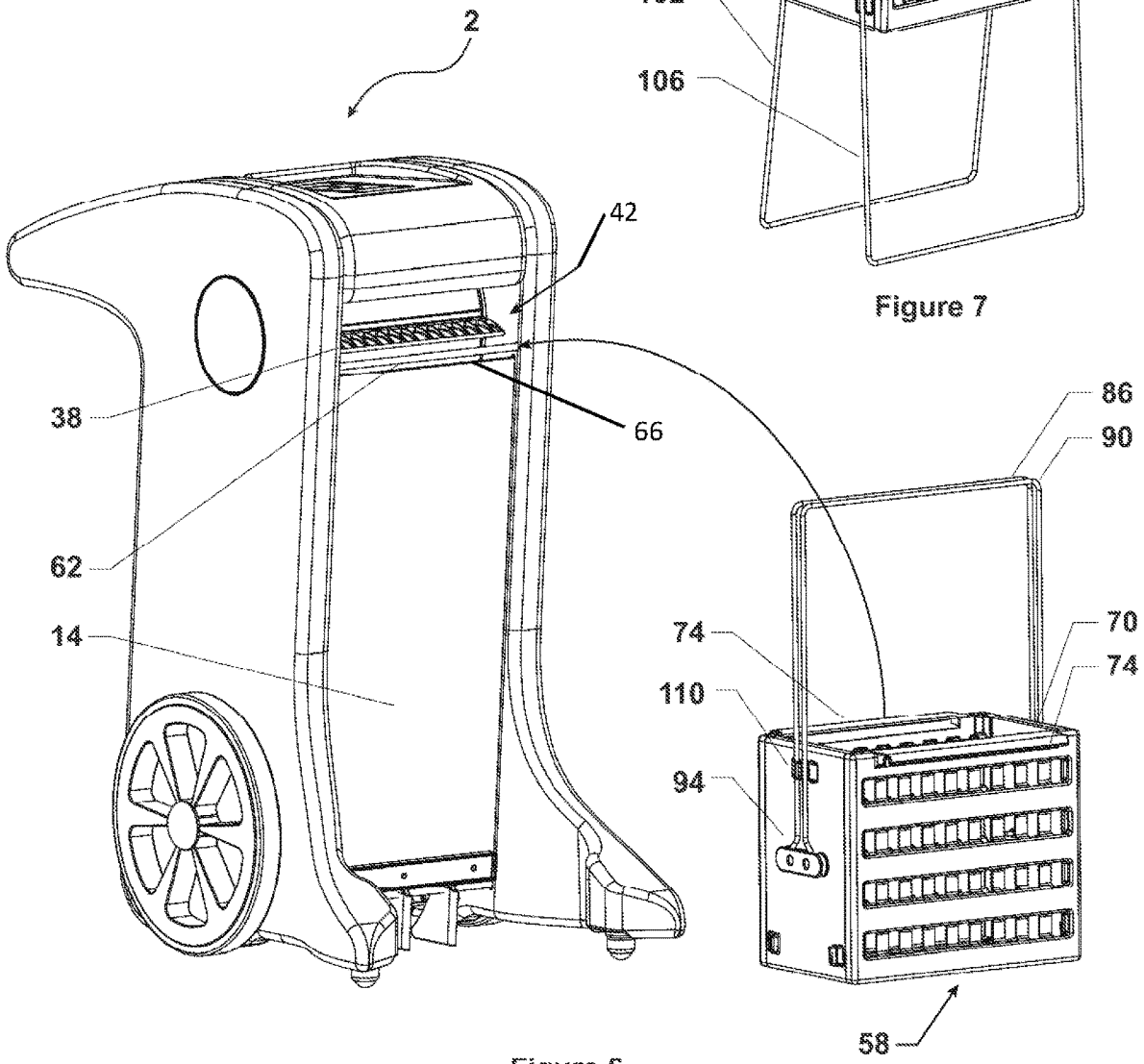
FIG. 6 is a front perspective view showing the ball collecting apparatus and associated basket.
Figure 8:
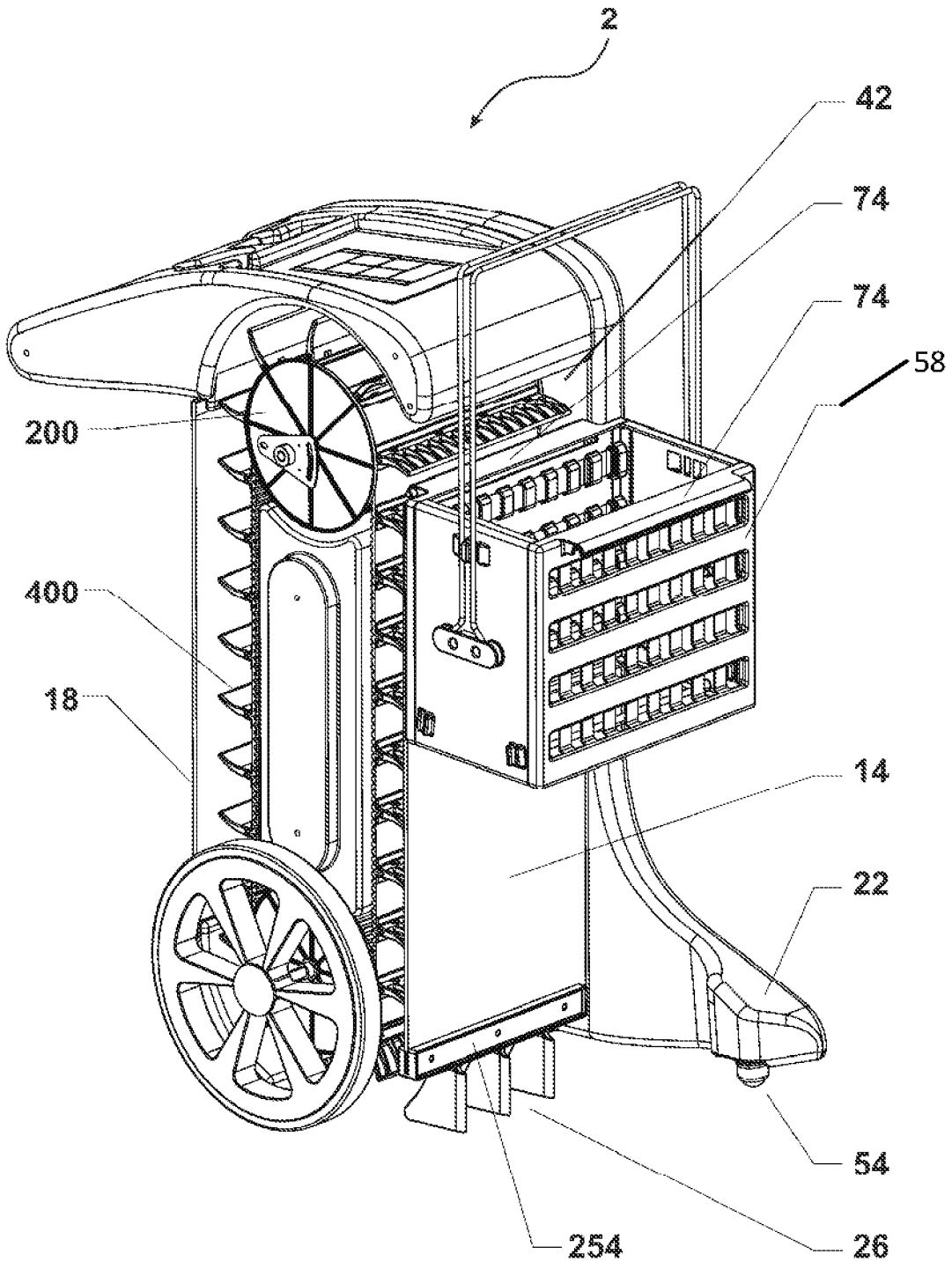
FIG. 8 is a cross-sectional front perspective view of the ball collecting apparatus of one embodiment of the present invention with the basket interconnected thereto.

FIGS. 6-8 show one embodiment of the present invention having a selectively interconnected basket 58 that receives collected balls. The ball collecting apparatus includes a basket support rod 62 that extends from the left panel 10 to the right panel 6. The basket support rod 62 generally corresponds with a lower edge 66 of the upper opening 42 of the front panel and is contoured to selectively receive the basket 58. One of ordinary skill in the art will appreciate the basket 58 may be configured such that it engages the lower edge 66 without departing from the scope of the invention. Other embodiments provide small protrusions extending from inner surfaces of the left and right panels that receive corresponding hook members of the basket. As shown, the basket 58 includes at least one upper edge 70 defined by the basket's four sides. At least a portion of the upper edge 70 includes a hooked lip 74. In practice, the hooked lip 74 is selectively engaged onto the basket support rod 62 to maintain the position of the basket 58 on the ball collecting apparatus 2. In operation, as the ball collecting operation apparatus 2 is moved, balls are transported from the collecting surface through the upper opening 42 in the front panel 14. The basket 58 captures balls as they are ejected from the apparatus.

FIG. 8 provides a cross-sectional view of the ball collecting apparatus 2 of one embodiment of the present invention that shows how the basket 58 is interconnected to the basket support rod 62. This figure also shows the lower opening 26 of the front panel 14 and how the extensions 22 are configured to channel one or more balls into the lower opening 26. After the balls enter the lower opening 26, the moving ball transport system, which is moved by the rotating wheels, grabs the balls, and moves them incrementally upwardly towards the upper opening 42. As will be further explained below, balls are maintained in ball transport members and the rear panel 18. After balls reach the apex of the ball collecting apparatus, they are moved around an upper pulley and ejected out of the upper opening 42 into the basket 58.

After the balls are collected, the basket 58 may be removed from the ball collecting apparatus 2 and moved to a second location. As it may be desirable to position the balls closer to the tennis player's waist, one embodiment of the present invention provides a basket 58 with selectively alterable handles. FIG. 7 shows the basket 58 in a second configuration wherein a first handle 86 and the second handle 90 have been rotated about hubs 94 on the sides of the basket 58. After the first and second handles are rotated into a second position, they are locked in place by lower locks 98, thereby forming a first leg 102 and a second leg 106 that support the basket 58. The basket 58 may also include upper locks 110 that maintain the first and second handles in the configuration shown in FIG. 6. The basket 58 may incorporate integrated legs that may be of fixed length or have a length that is selectively alterable such that the distance between the lower portion of the basket and the end of the legs may be selectively altered to fit the player's needs. For example, telescoping legs may be provided that are concealed within the basket when not in use. One of ordinary skill of the art should appreciate that the handles/legs provided in FIGS. 6 and 7 are not limiting, and many ways of supporting the basket at a height above the collecting surface may be provided. Those of skill in the art should also appreciate that a removable basket may not be employed. For example, one embodiment of the present invention includes a fixed basket, wherein the ball collecting apparatus must be moved to the location in which the individual is practicing.

Figure 9:
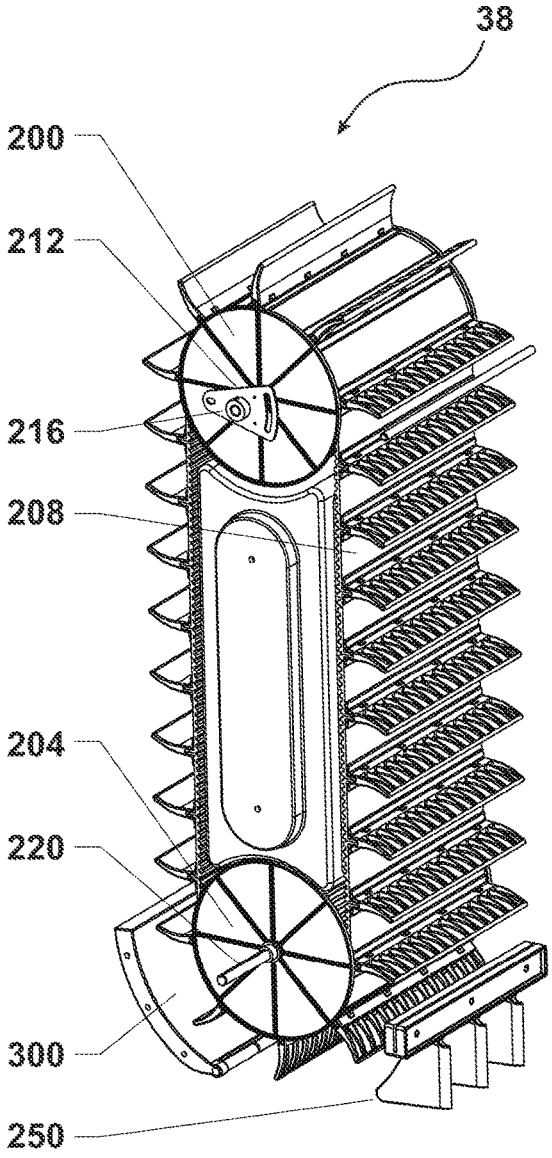
FIG. 9 is a perspective view of a ball transport system of one embodiment of the present invention.
Figure 10:
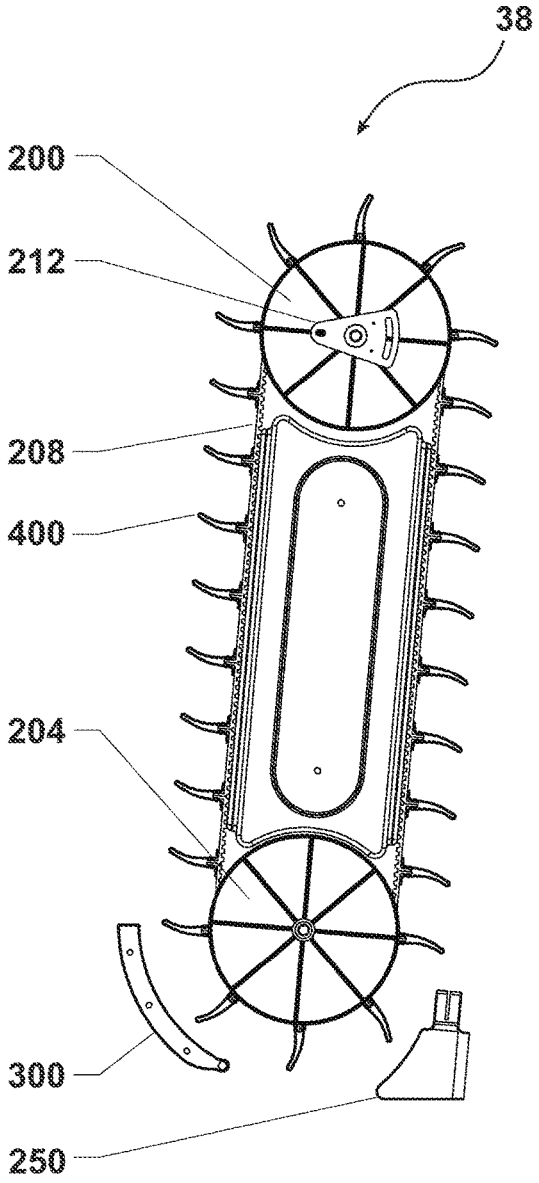
FIG. 10 is a side elevation view of FIG. 9.
Figure 11:
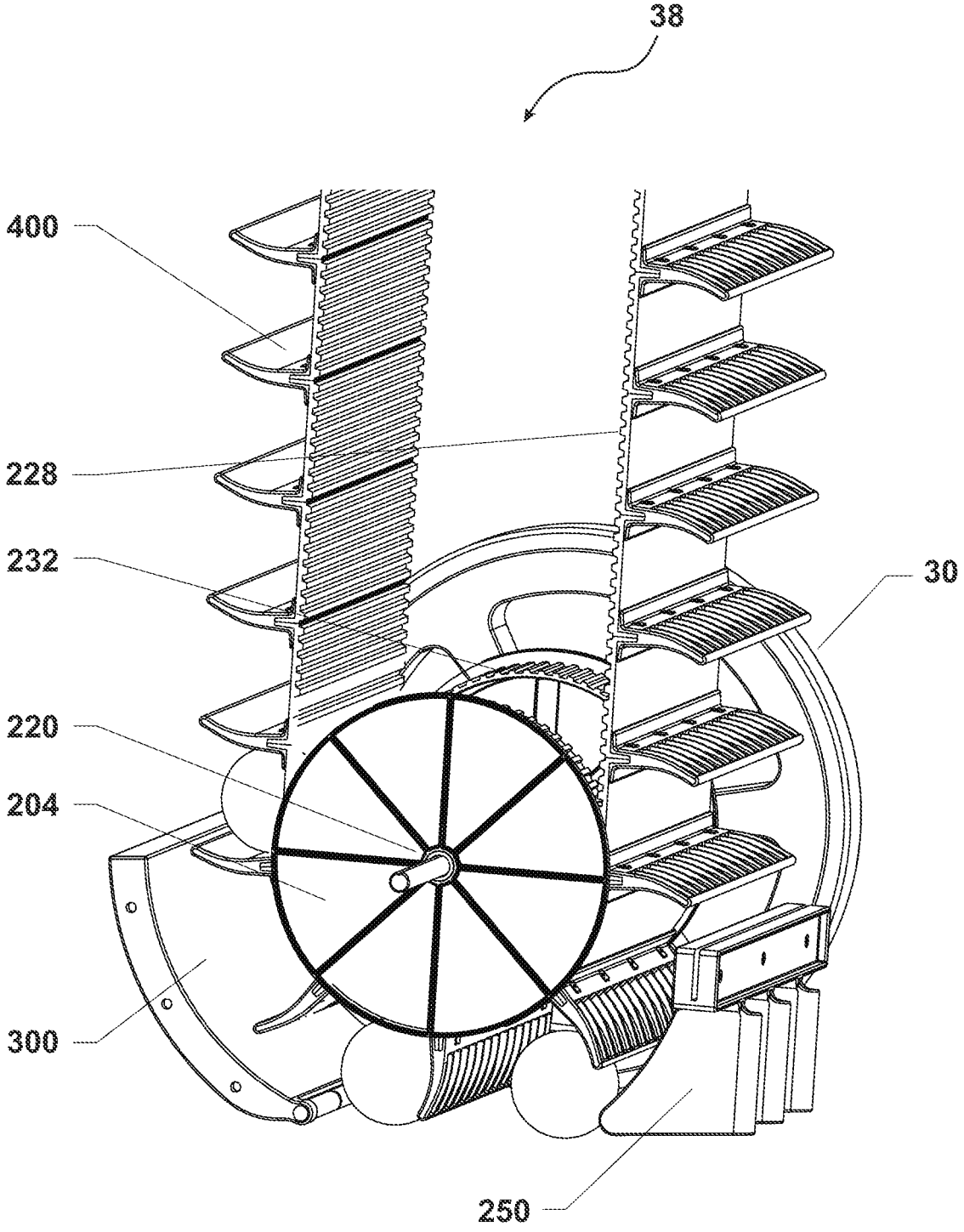
FIG. 11 is a detailed view of FIG. 9.

FIGS. 9-11 show the ball transport system 38 of one embodiment of the present invention. The ball transport system comprises an upper pulley 200 and a lower pulley 204. As described in further detail below, each pulley may comprise left and right pulley members that selectively engage a belt 208. This pulley configuration comprising separate elements that engage lateral edges of the belt is lighter than a pulley in the form of a drum that engages the entire width of the belt. The upper pulley 200 may be selectively adjustable such that the tension of the belt 208 can be selectively maintained. More specifically, over time, the belt 208 may become slacker, which can reduce its effectiveness when the pulleys are rotated. Temperature variations can also cause the belt to slacken. Thus, some embodiments of the present invention employ a plate 212 operatively interconnected to an axle 216 associated with the upper pulley 200. Movement of the plate 212 will selectively move the axle 216 upward or downward to alter belt tension. The lower pulley 204 includes an axle 220 selectively interconnected to the left or right wheel via a geared interface such that when the left or right wheel rotates, the lower pulley 204 will rotate and move the belt 208. The upper pulley 200 can "freewheel" and is not driven by an external force, other than interaction with the belt. Regarding freewheeling, embodiments of present invention employ a gearing system associated with the lower pulley 204 such that it can only rotate in one direction, the direction that facilitates moving balls from the lower opening of the front panel to the upper opening. More specifically, the wheel that rotates the lower pulley is interconnected to the lower pulley by way of a freewheel needle bearing, wherein rotation of the wheels in the opposite direction, i.e., to reverse the ball collecting apparatus, will not rotate the lower pulley 204.

FIGS. 9-11 also show a plurality of ball guides 250 interconnect to a bar 254 that is interconnected to the lower edge of the front panel 14. The ball guides 250 help direct balls from the lower opening to the ball transport system. The ball guides 250 also help prevent clogging. Although three ball guides are shown, one of ordinary skill in the art will appreciate that any number of ball guides can be employed without departing from the scope of the invention.

Figure 12:
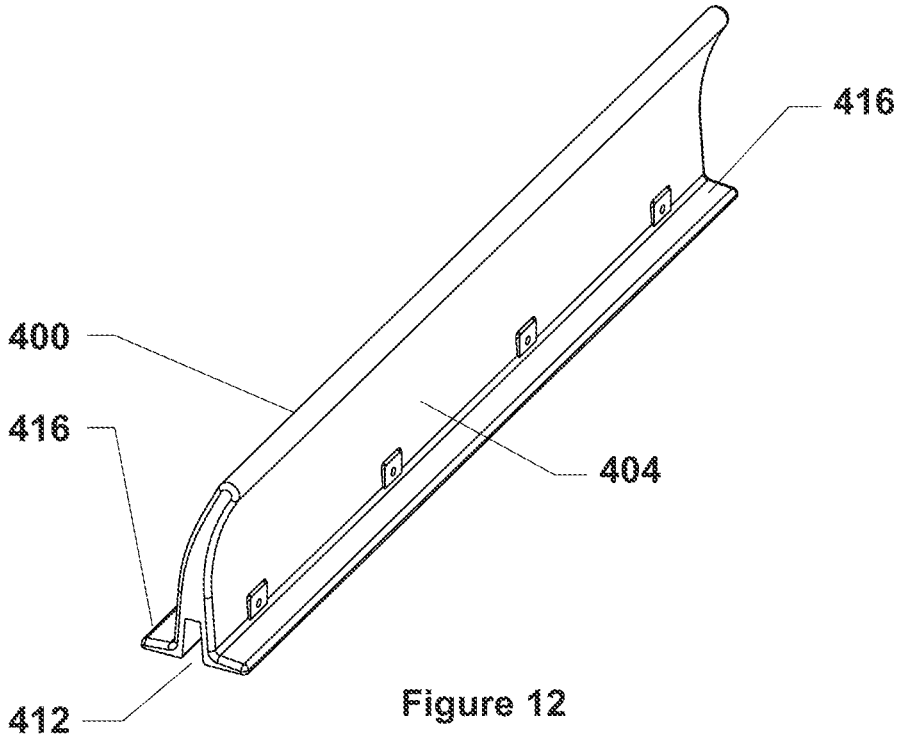
FIG. 12 is a perspective view showing an upper surface of a ball lift segment of one embodiment of the present invention.
Figure 13:
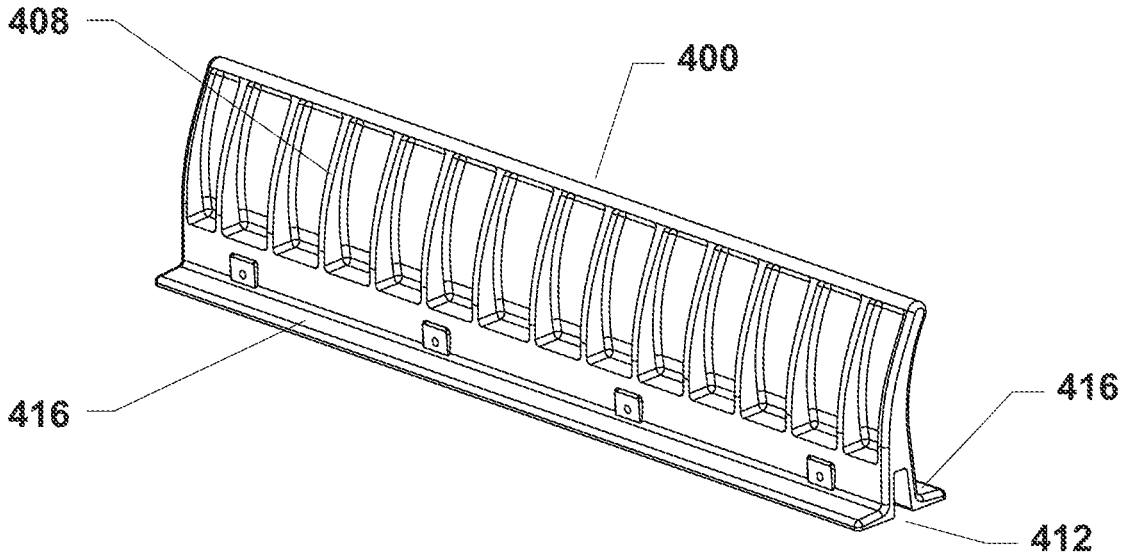
FIG. 13 is a perspective view showing an underside of the ball lift segment shown in FIG. 12.

Referring additionally to FIGS. 12 and 13, the belt transport system selectively engages balls that enter through an opening in the front panel. The balls are urged along the ball collecting surface and engage a ball scoop 300 which transitions the balls from a horizontal plane to a vertical plane. After the balls are transitioned into the vertical plane, they are held by ball transport members 400 spaced along the outer edge of the belt 208. The belt 208 includes an inner surface with a plurality of ridges 228 that engage a plurality of teeth 232 on the pulleys 200 and 204 which transmit rotational motion of the pulleys to lateral motion of the of the belt. As the lower pulley 204 is rotated, the belt 208 is moved which moves the balls upwardly towards the upper pulley 200. After the balls reach the apex of the upper pulley 200, gravity will cause them to disassociate with the ball transport member 400 and fall into the basket.

FIG. 11 is a detailed view showing how one or more balls 500 are initially engaged by the belt 208. An upper surface 404 of the ball transport members engages an outer surface of the ball 50. Further movement of the ball collecting apparatus rotates the lower pulley 204, which will incrementally move the belt 208 by way of interaction of teeth 232 on the pulley and ridges 228 on the belt. The balls 500 will eventually come in contact with a ball scoop (not shown) which helps transition the balls 500 from the horizontal plane to the vertical plane. The ball transport members 400 can be spaced such that they closely match the diameter of the ball 500 being collected, which further helps keep the balls 500 onto the upper surface 404 of the ball transport members.

FIGS. 12 and 13 show ball transport members of one embodiment of the present invention. The upper surface 404 of the ball left segment employs a curve upper profile which terminates at a curled end. The curved profile helps scoop the balls from the ball collecting surface and to maintain them on the upper surface 404 as they are transitioned from horizontal plane to the vertical plane. The ball transport members may include a plurality of stiffening ribs 408 to provide additional rigidity while reducing weight. The ball transport members also include a longitudinal channel 412 or pocket, or series of pockets that extend at least partially the width thereof. The channel 412 is adapted to selectively receive a portion of a belt segment as described below. The ball transport members may also include upper and lower feet 416 that engage the outer surface of the belt, which helps increase stability of the ball transport members relative to the belt segment. Stated differently, the feet 416 help prevent relative motion of the ball transport members relative to the belt transport members and provides a rigid, generally 90° interconnection between the ball transport members and the belt.

Figure 14:
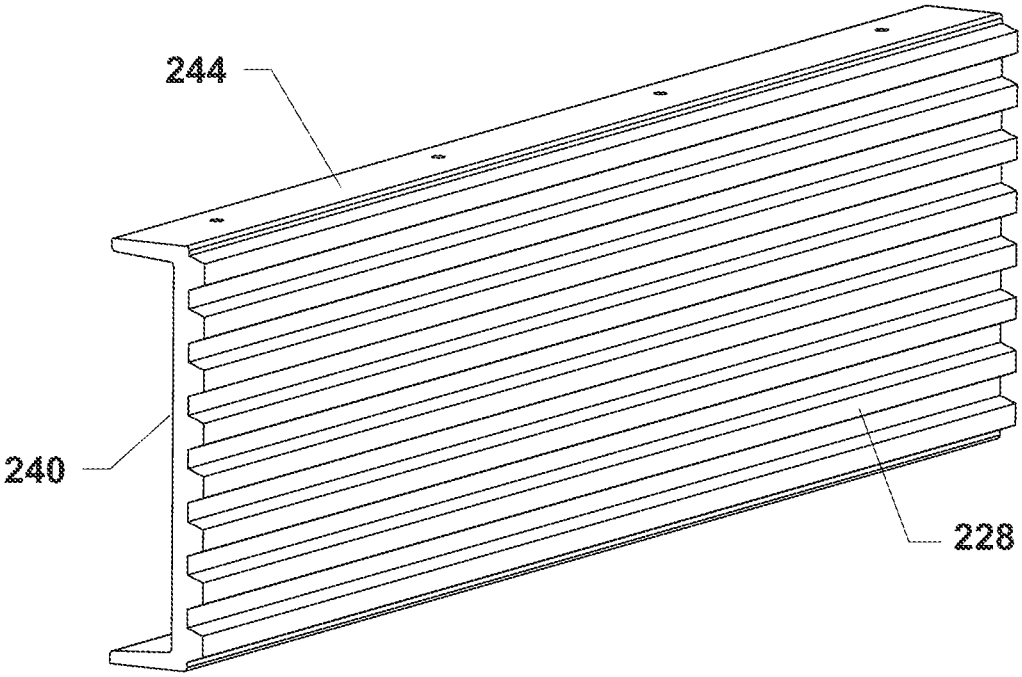
FIG. 14 is a perspective view showing a belt segment of one embodiment of the present invention.

FIG. 14 shows a belt segment 240 of one embodiment of the present invention. As described above, the ball transport members are selectively interconnected to the belt 208 that generally spans the entire height of the ball collecting apparatus. The belt 208 of one embodiment of the present invention is made from a plurality of segments 240 interconnected to each other by the ball transport members 400 (see, for example, FIG. 16). The belt segments 240 include a generally smooth outer surface and an inner surface with ridges 228 that selectively engage corresponding teeth 232 (see, for example, FIG. 15) on the lower and upper pulleys. The belt segment 240 may also include an upper and lower tab 244 that extend from the outer surface of the belt segment 240. The tabs of belt segments 240 are selectively engaged and held together when placed within the channel (412, See FIGS. 12 and 13) provided by the ball transport members. Fasteners can interconnect the ball transport members to the belt segments 240 wherein the fasteners are placed through the upper or lower surfaces of the transport members and maintained by a nut or other fastening device associated with the opposite side of the ball transport members. In this way, the upper and lower edges of the belt segments 240 are sandwiched together and maintain within the channel of the ball transport members. Those of ordinary skill in the art will appreciate the tab 244 associated with the belt segments 244 need not extend the entire width thereof and smaller tabs may be employed. If belt segments 240 become worn or damaged, they can be easily replaced by removing the fasteners associated with the ball transport members.

Figure 15:
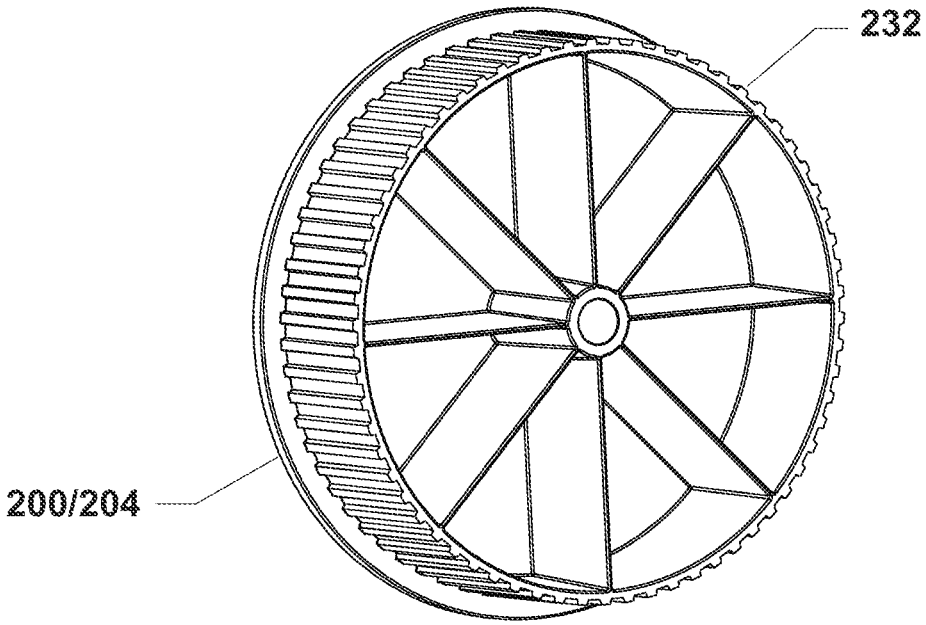
FIG. 15 is a perspective view of a pulley used by one embodiment of the present invention disclosed herein.

FIG. 15 shows the pulley of one embodiment of the present invention. As discussed above, the pulleys may comprise two pulley wheels (See FIG. 11) as shown in FIG. 15. The pulley includes an outer surface with teeth 232 that selectively engage ridges on the inner surface of the belt segments to help propel the same.

Figure 16:
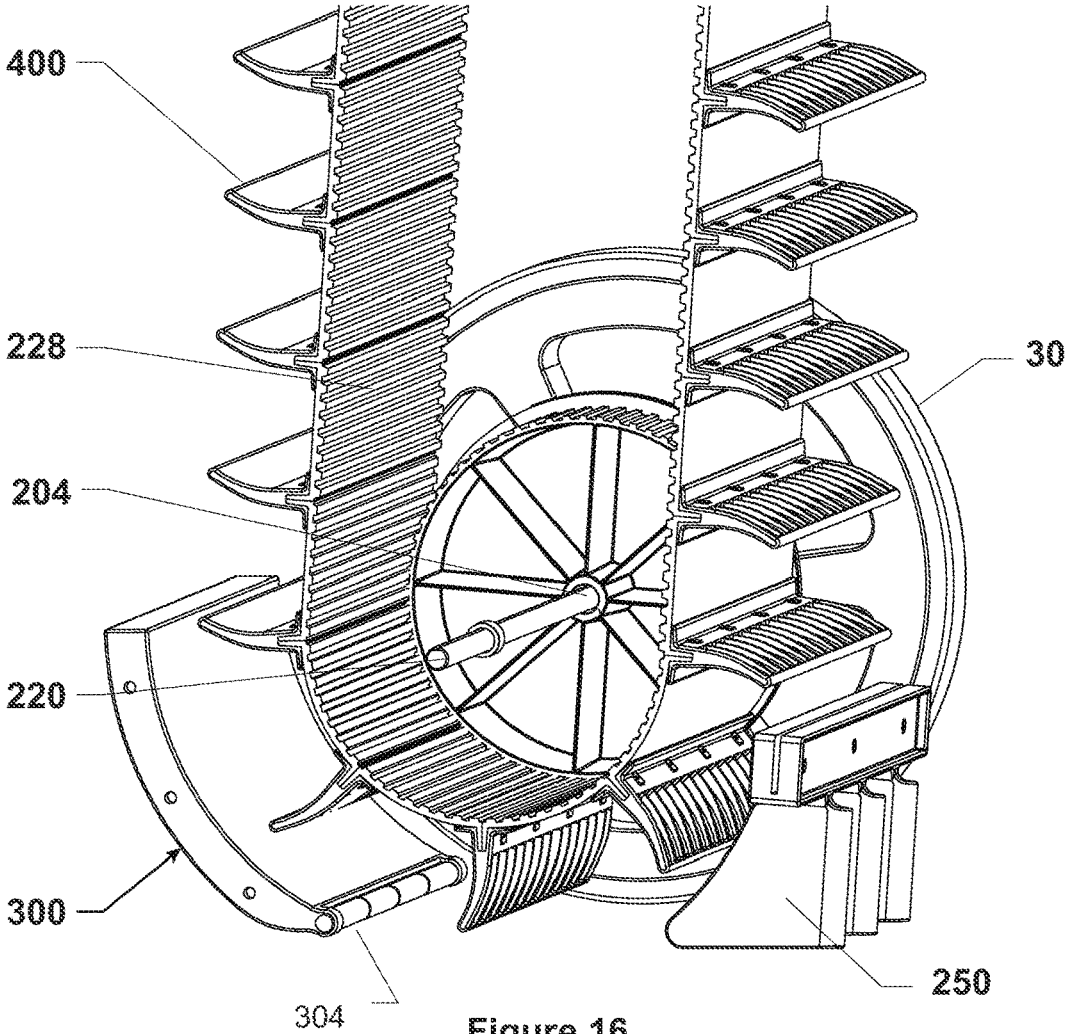
FIG. 16 is a cross-sectional view of the bottom portion of the ball collecting apparatus of one embodiment of the present invention.

FIG. 16 shows a belt comprising a plurality of belt segments maintained by the ball transport members. Again, the tabs 244 associated with adjacent belt segments 240 are placed within the cavity provided by the ball transport members. The tabs 244 may be maintained within the channels 412 by any common method, such as gluing, welding, ultrasonic welding, fasteners, etc. However, fastening allows for a selective interconnection scheme wherein ball transport members can be selectively removed and replaced if needed. FIG. 16 also shows the interplay between the teeth 232 provided by the lower pulley 204 and the ridges 228 provided by the inner surface of each belt segment 240.

Figure 17:
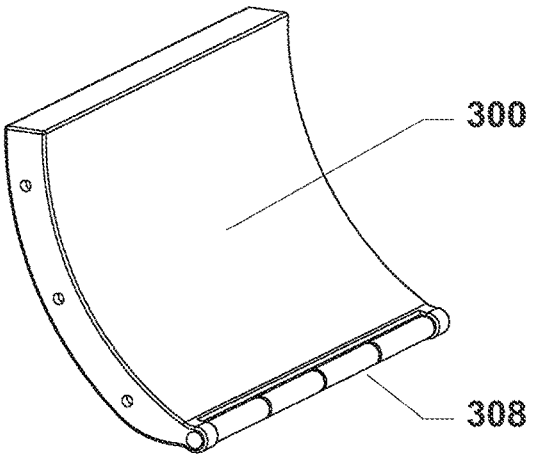
FIG. 17 is a perspective view of a ball scoop employed by one embodiment of the present invention

FIG. 16 also shows the ball scoop 300 associated with one embodiment of the present invention, which is also shown in detail in FIG. 17. The ball scoop 300 helps transition collected balls being urged rearwardly by ball transport systems from the horizontal plane to the vertical plane. The balls contact a leading edge 304 of the ball scoop 300 and ride on the ball scoop 300 and are eventually positioned on the upper surface of the ball transport systems. The ball transport systems will then raise the balls upwardly as described above. Because it is often important to maintain a close tolerance between the leading edge 304 and the collecting surface so balls do not jam between the ball scoop 300 and the collection surface, one embodiment of the present invention employs a leading-edge roller 308 that facilitates interaction between the balls so they easily move along the ball scoop. The leading-edge roller 308 also may contact the collecting surface to eliminate any gap between the leading-edge 304 and the ball collecting surface.

Figure 18:
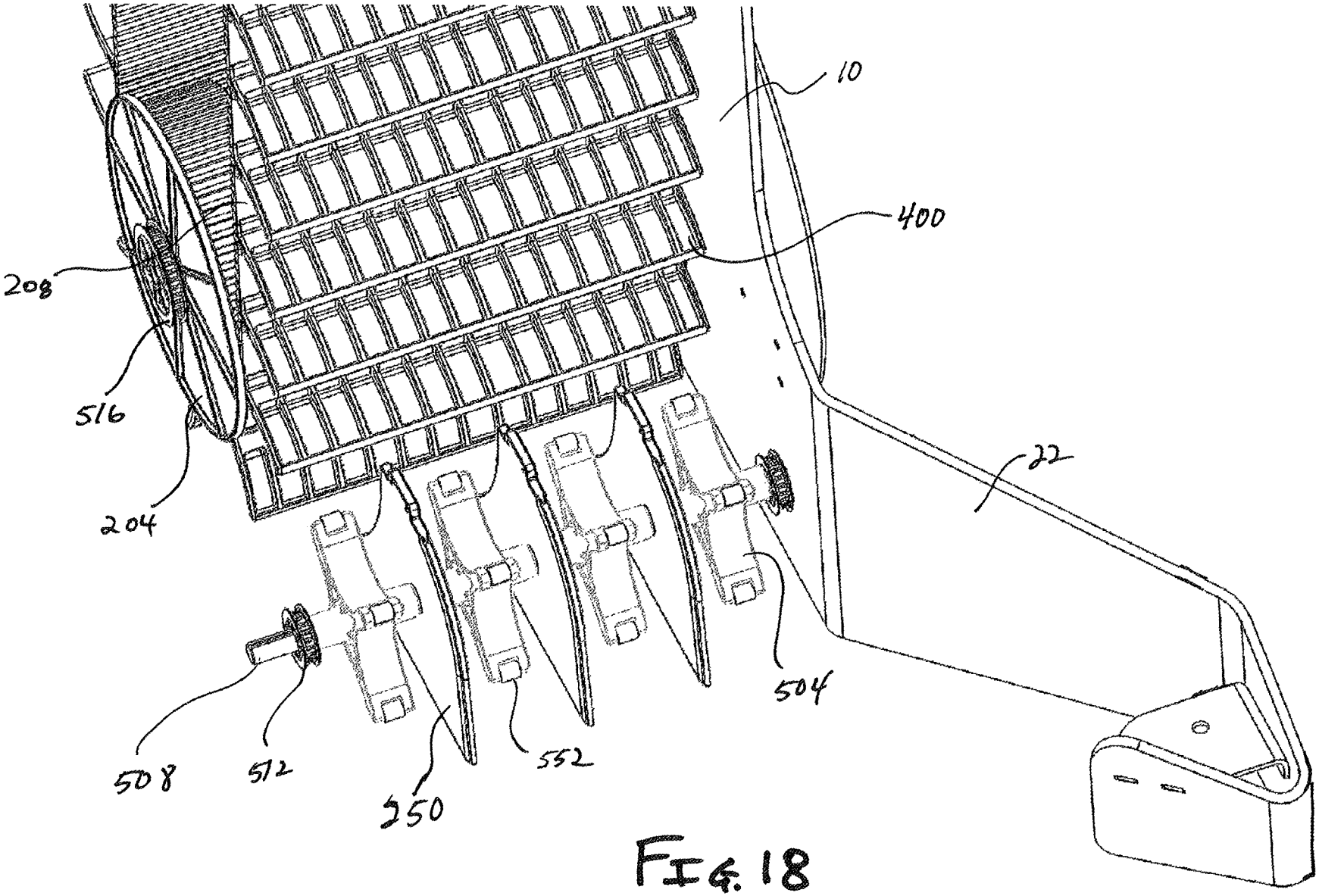
FIG. 18 is a detailed perspective view showing a turnstile employed by some embodiments the present invention.

FIGS. 18-23 show features employed by some embodiments of the present invention. More specifically, in addition to the features, components, subassemblies, etc. described above, some embodiments of the present invention employ one or more turnstiles 504 that facilitate transferring balls 500 to the ball transport members 400. The turnstiles 504 are positioned on a turnstile shaft 508 interconnected to the left panel 10 and the right panel 6 (or associated extension 22). The turnstiles are fixedly interconnected to the turnstile shaft 508, wherein shaft rotation rotates the turnstiles. In one embodiment, the turnstile shaft is interconnected to a first timing gear 512 that rotates and moves the turnstile shaft 508. A second timing gear 516 is interconnected to the lower axle 220 or the lower pulley 204. As shown in FIG. 18, the second timing gear 516 is associated with the lower pulley 204 and positioned on the right side of the ball collecting apparatus, one of ordinary skill in the art will appreciate the second timing gear 516 may be associated with the lower pulley associated with the left panel 10. Still further, some embodiments of the present invention employ second timing gears 516 associated with both lower pulleys. Similarly, the turnstile shaft 508 may include to first timing gears 512 located near the left panel 10 and the right panel 6. A timing belt 520 (see FIG. 20) interconnects the second timing gear 516 to the first timing gear 512, wherein rotation of the second timing gear 516 will rotate the first timing gear 512. Alternatively, rotational movement may be imparted directly onto the turnstiles. That is, the turnstile shaft is fixed and the first timing gear 512 is interconnected to a turnstile, wherein rotation of the first timing gear will rotate one or more turnstiles.

In another embodiment, the first timing gear 512 is motorized and the second timing gear and timing belt are omitted.

Figure 19:
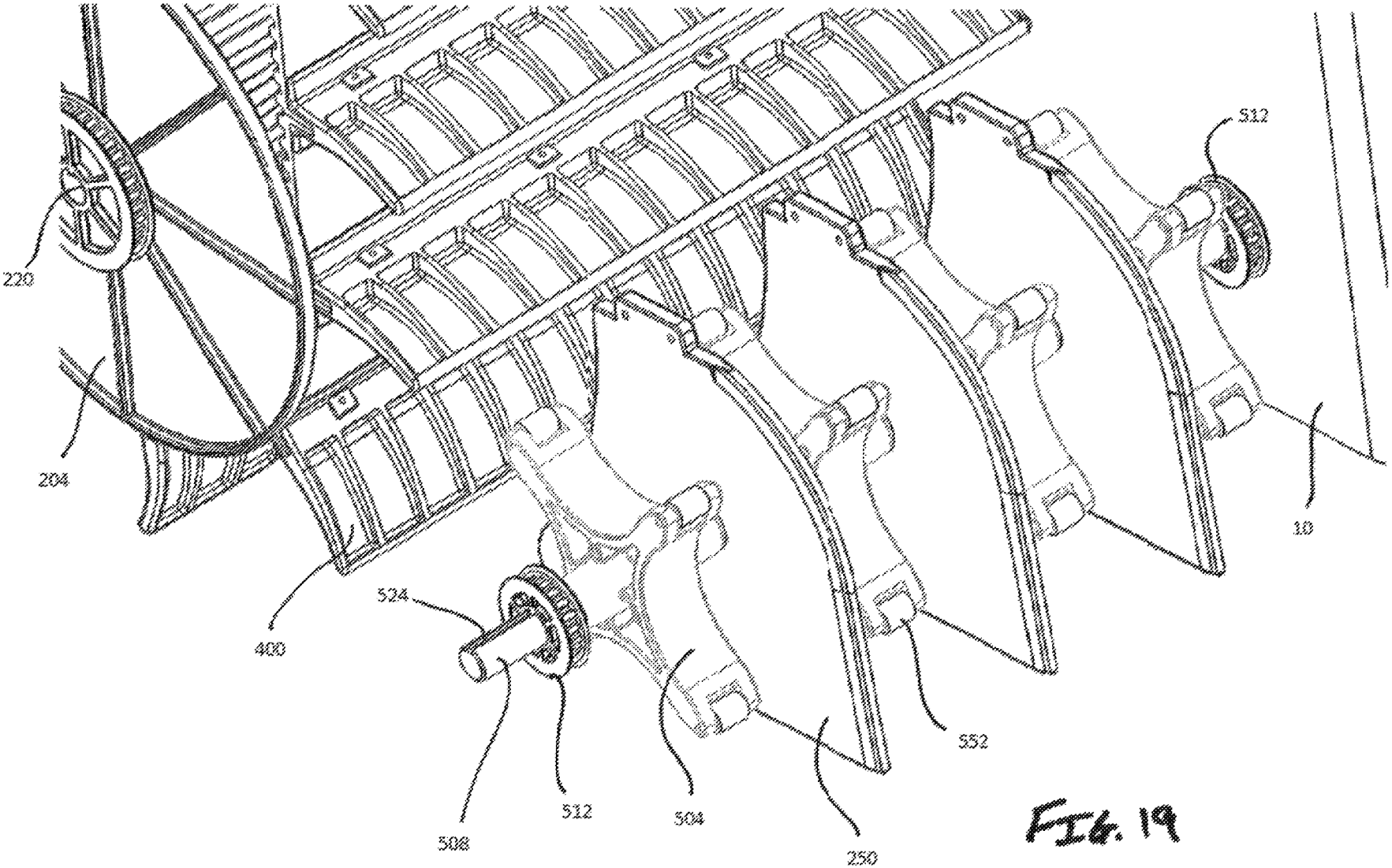
FIG. 19 is another detailed perspective view showing the turnstile employed by some embodiments of the present invention.

FIG. 19 shows the turnstile shaft 508 and interconnected components in greater detail. Here, the turnstiles 504 and the first timing gear 512 are interconnected to the turnstile shaft 508 by way of a keyed interconnection. More specifically, the turnstile shaft 508 of one embodiment of the present invention includes a channel 524 extending along its outer surface from a first end of the turnstile shaft to a second end of the turnstile shaft. A protrusion (not shown) extends from the inner surface of the first timing gear 512 and fits within the channel 524 so that turnstile shaft rotation will rotate the first timing gear 512. The channel 524 also accommodates a protrusion in the turnstiles in a similar fashion. In an alternative embodiment shown herein, the turnstile shafts include a key groove 528 (see FIG. 21) that interfaces with a protrusion extending from the turnstile shaft or a member that links the key groove and the channel 524, a common way of mating components to a shaft that should be understood by those of ordinary skill in the art.

Figure 20:
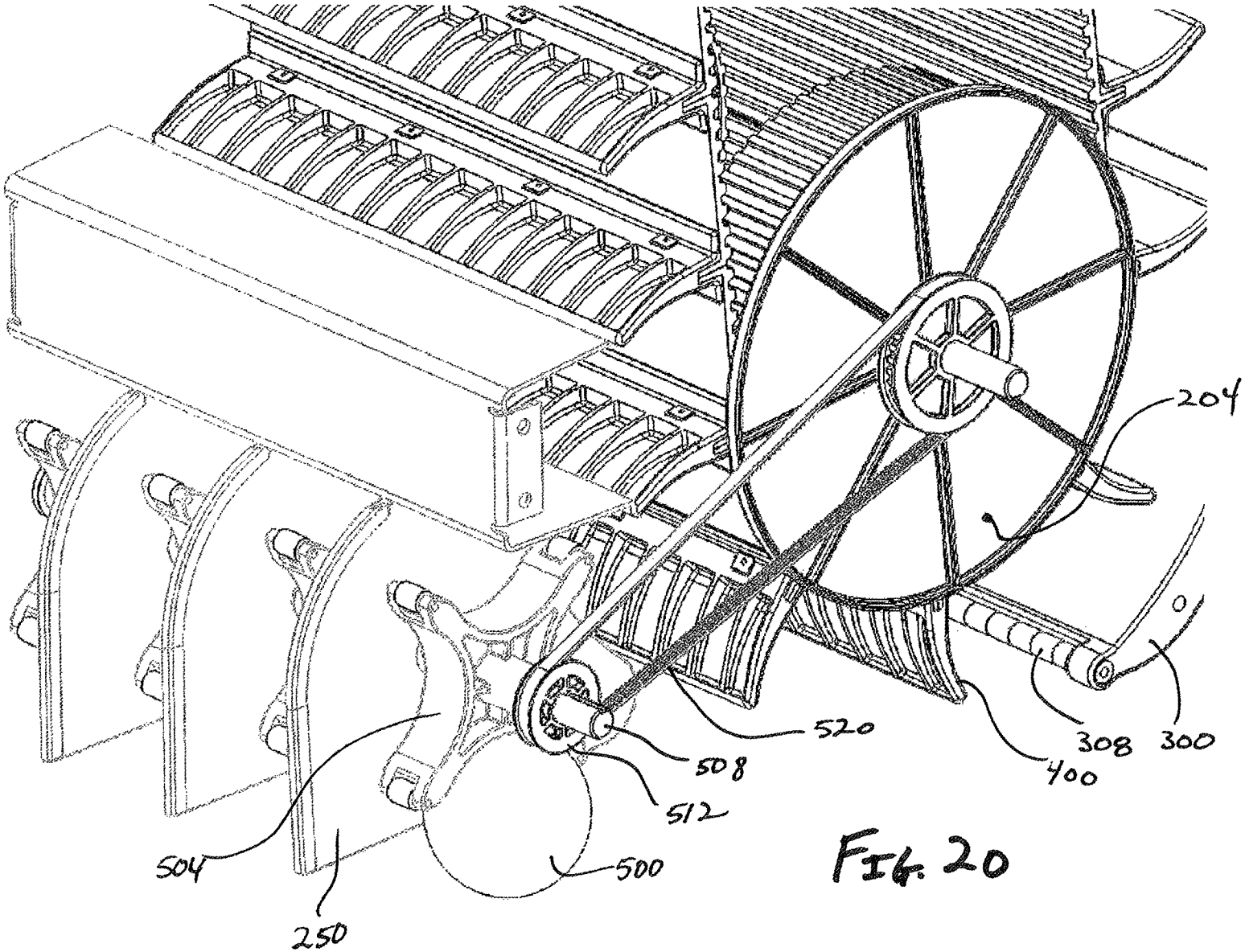
FIG. 20 is a detailed perspective view showing the turnstiles of one embodiment of the present invention engaging a ball.

FIGS. 18-20 also illustrate the ball guides 250 employed by some embodiments the present invention. The ball guides 250 are positioned on each side of interior turnstiles. The external turnstiles (i.e., those adjacent to the right panel 6 and the left panel 10) only require one ball guide 250. As described above, the ball guides 250 are configured to provide a chute slightly larger than the outer diameter of the ball being collected, for example, a tennis ball. The chute prevents multiple balls from entering the ball transport system, which could create a jam. The turnstiles 504 also help to ensure a smooth transition of balls under the turnstile shaft 508 into the ball transport system. The ball guides 250 of one embodiment of the present invention are fixed relative to the rotating turnstiles 504. One of ordinary skill in the art will appreciate, however, that ball guides may be interconnected to the turnstile shaft 508 and rotate therewith. Indeed, some embodiments the present invention employ a subassembly comprised of the first timing gear(s), a plurality of turnstiles, and plurality of ball guides. In this example, rotation of the first timing gear about a fixed turnstile shaft will rotate the subassembly. Alternatively, the contemplated subassembly is fixedly attached to the turnstile shaft which rotates the subassembly when the first timing gear 512 rotates.

Figure 21:
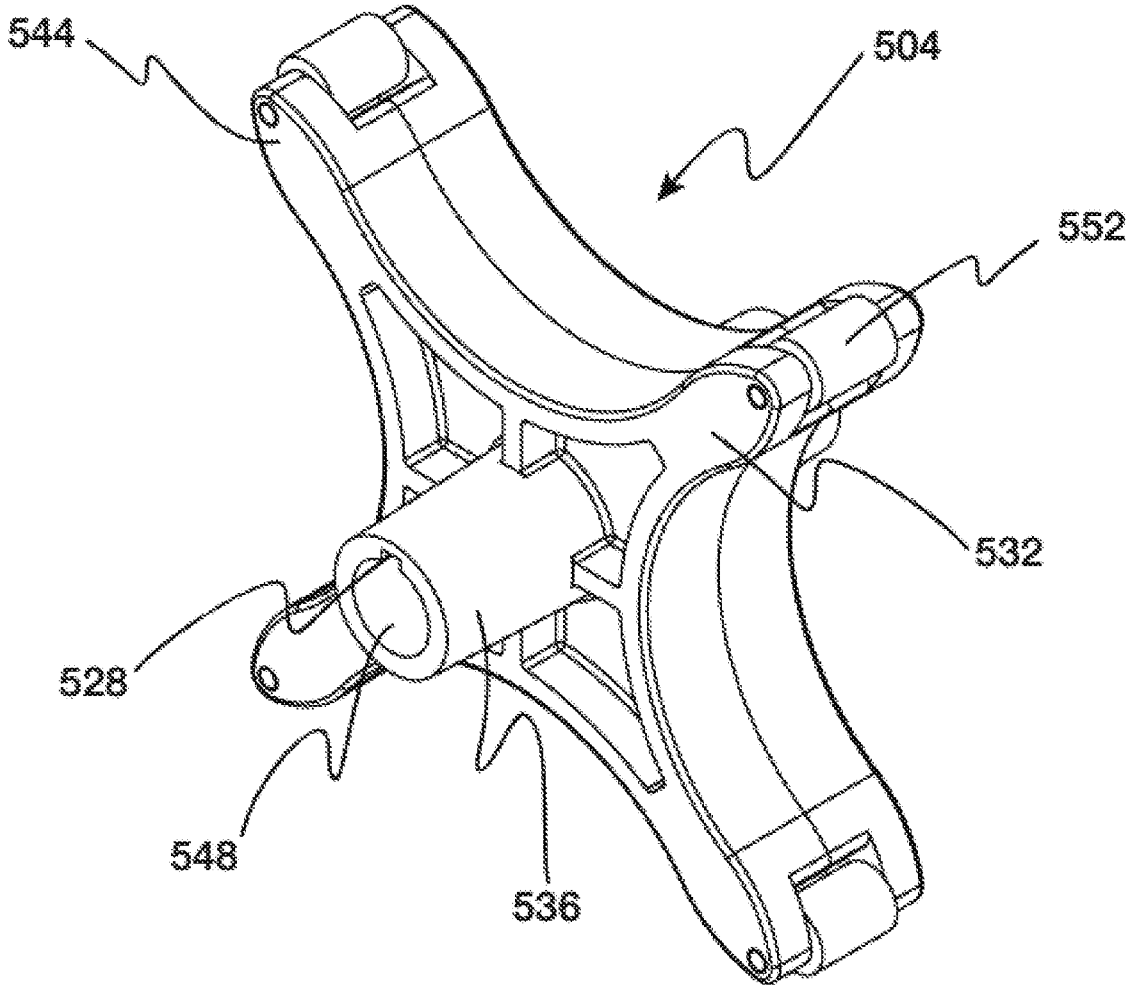
FIG. 21 is a perspective view of a turnstile of one embodiment of the present invention.

FIG. 21 shows the turnstile 504 of one embodiment of the present invention comprised of four arms 532 that extend from a central hub 536. One of ordinary skill in the art will appreciate that the turnstile may employ any number of arms so long as they operate to urge balls into the ball transport system. Each arm 532 is defined by arcuate walls 540 that meet at a tip 544. The arcuate walls 540 may correspond to the diameter of the balls being collected, which provides a smooth transition of balls into the ball transport system. The hub 536, which may extend from the lateral surfaces of the arms, includes an internal opening that receives a turnstile shaft. An inner surface 548 of the hub may include the key groove 528 as described above. In one embodiment of the present invention, each turnstile arm includes a roller 552 integrated into the tip. Alternatively, the tips 544 may be compliant and deformable to accommodate balls that contact the rotating turnstiles in a manner that would normally cause a jam, which will be appreciated after operation of the turnstiles is described in further detail below.

Figure 22A:
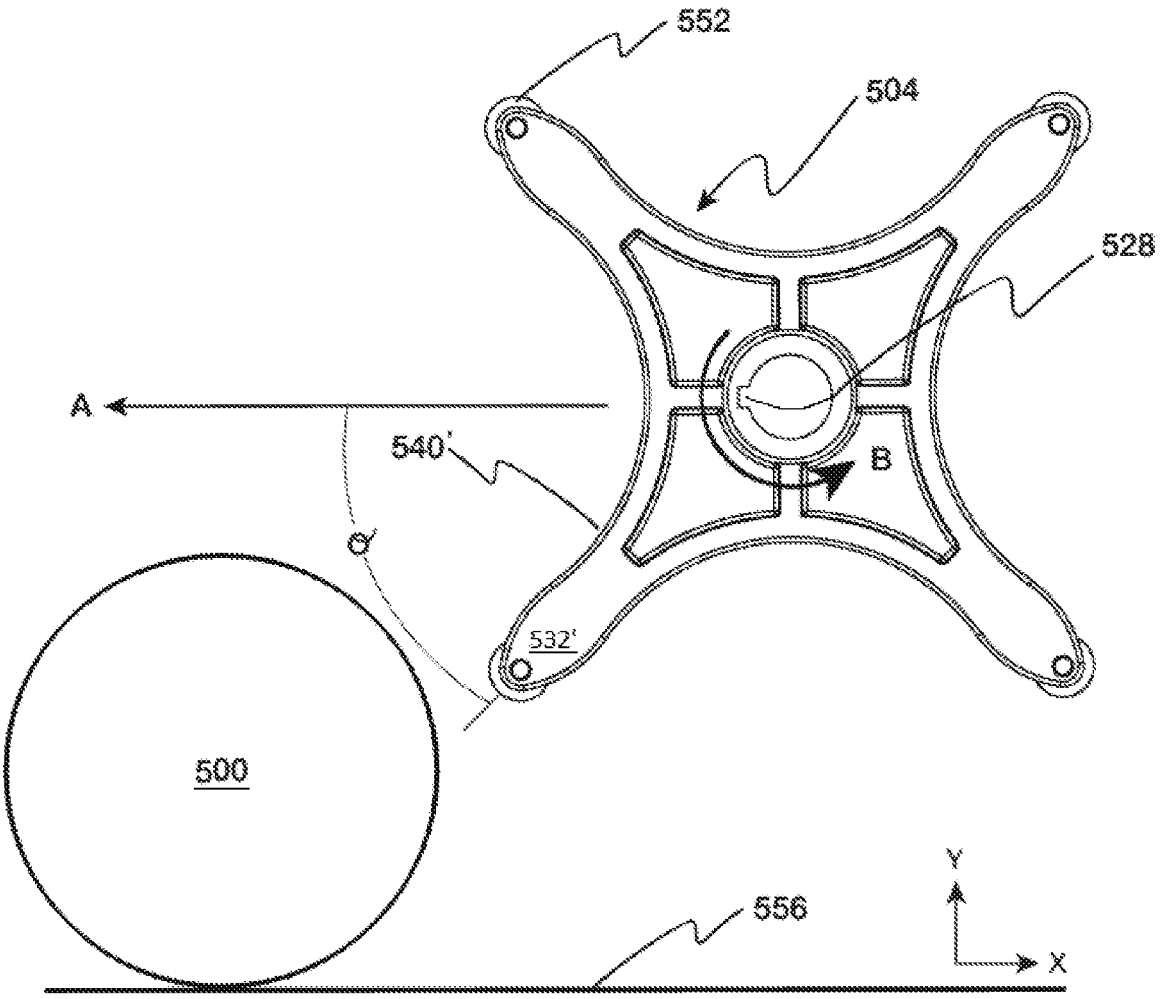
FIG. 22A is a simplified representation illustrating how the turnstile initially engages a ball.
Figure 22B:
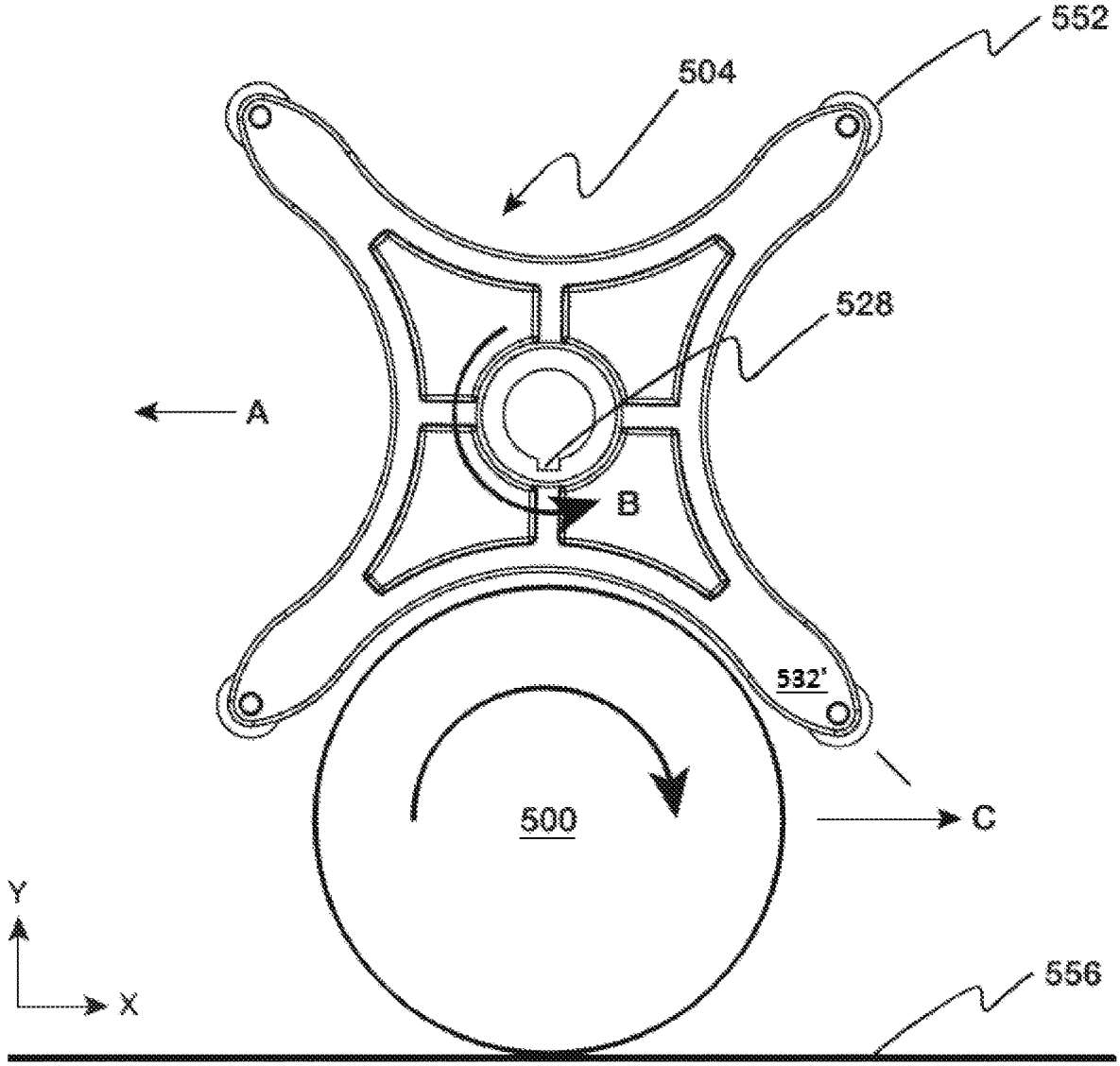
FIG. 22B is a simplified representation showing the ball captured by the turnstile.
Figure 22C:
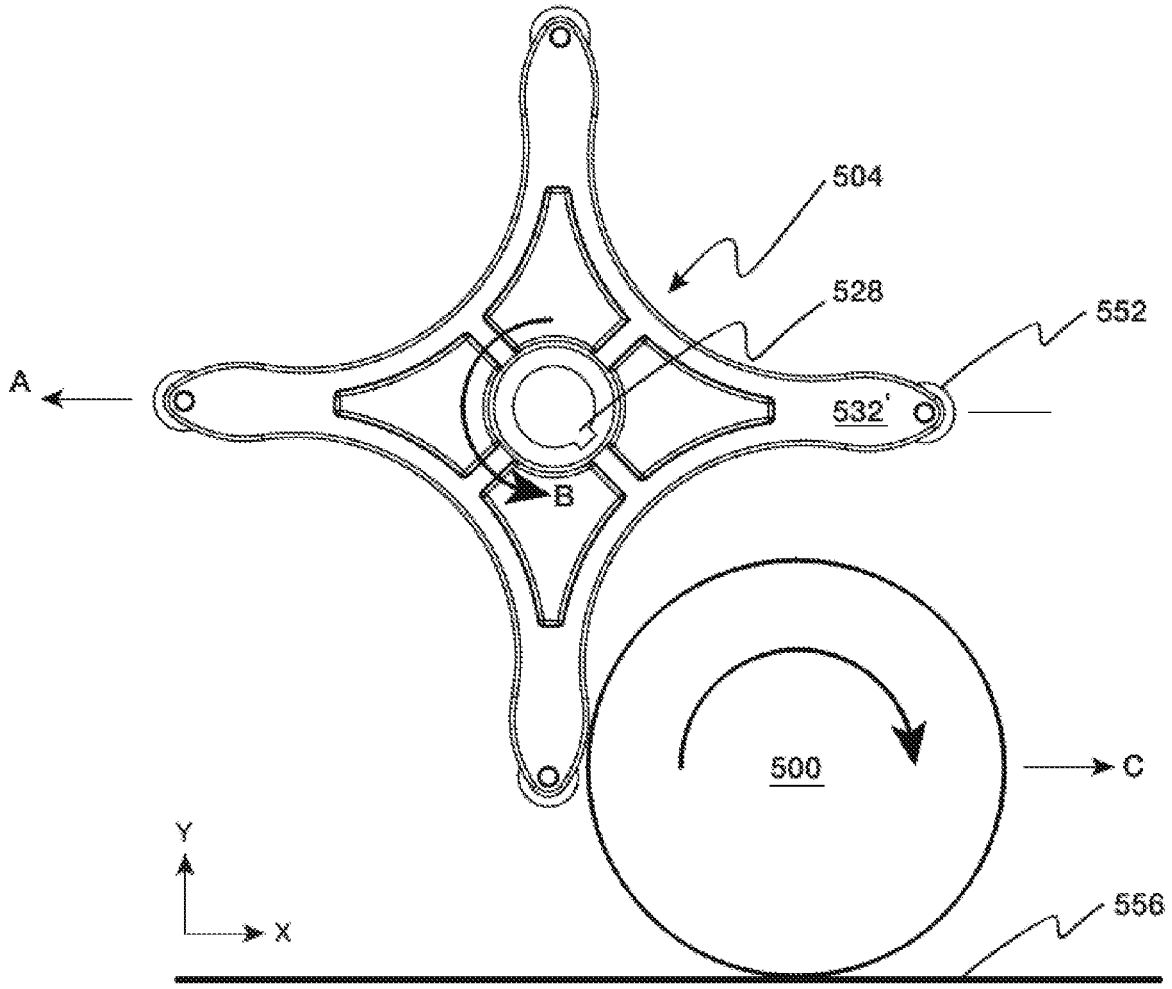
FIG. 22C is a simplified representation showing the ball being ejected by the turnstile.
Figure 22D:
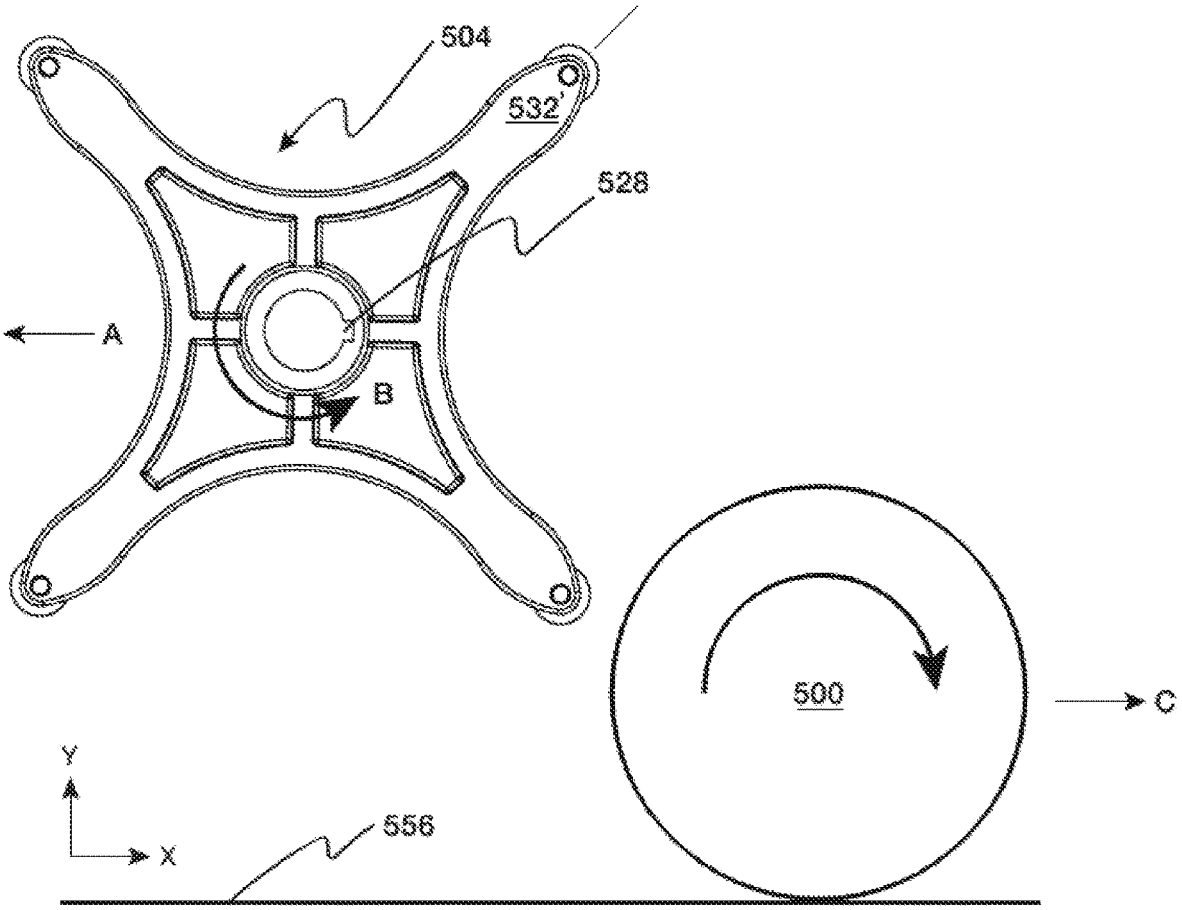
FIG. 22D is a simplified representation showing the ball moving away from the turnstile.
Figure 23:
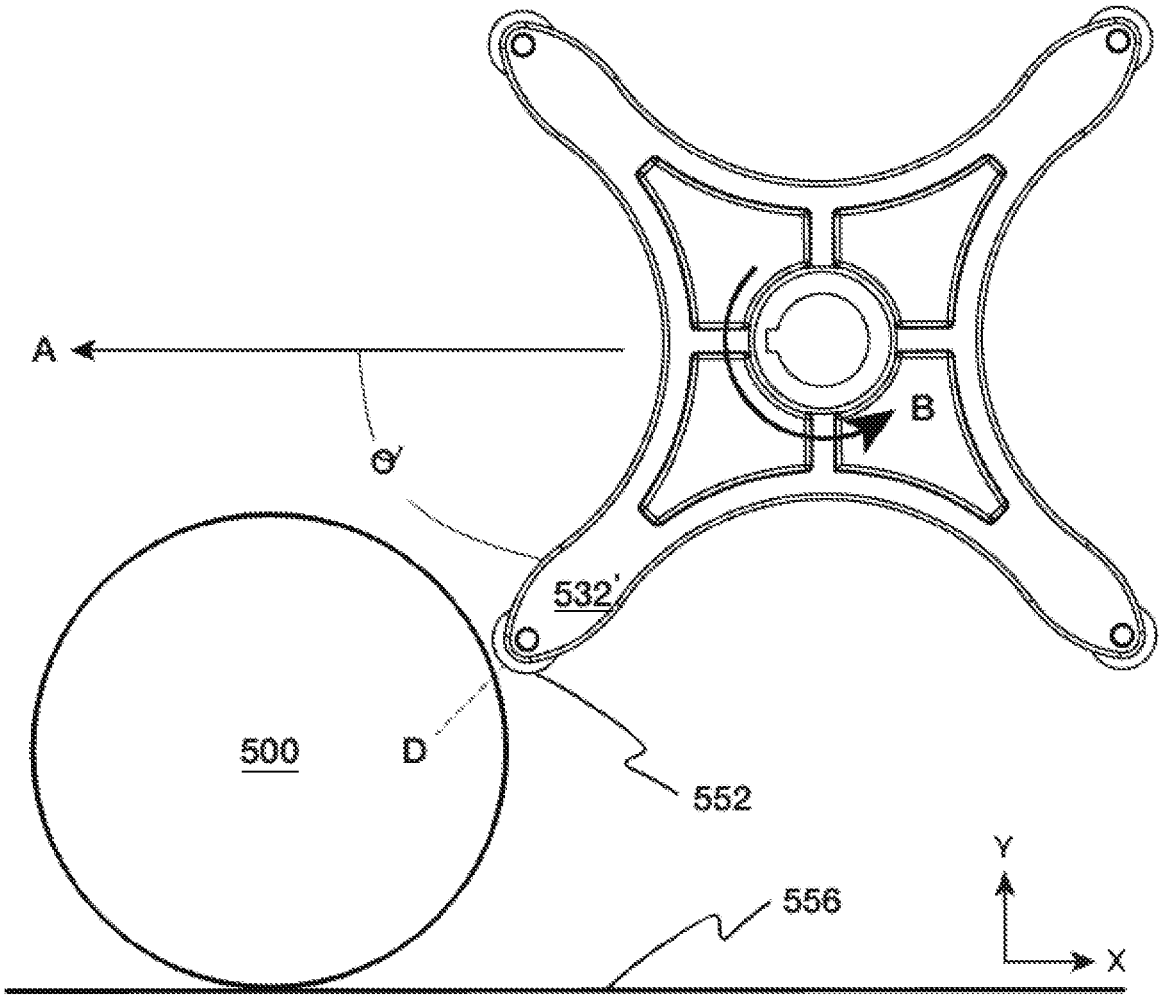
FIG. 23 is of a representation showing the interaction of the turnstile and ball when the turnstile is at a particular angular orientation.

FIGS. 22 and 23 illustrate how the rotating turnstiles 504 interact with a ball 500 resting on a flat surface 556. FIG. 22A shows the rotating turnstile 504 just before engaging a resting ball 500. Here, forward movement of the ball collecting apparatus moves the turnstile 504 in the direction of Arrow A. As discussed above, movement of the apparatus will impart rotation on the lower axle and lower pulley, which will also impart rotation on the second timing gear that in turn rotates the first timing gear and turnstile in the direction of Arrow B via the turnstile shaft. Ideally, balls 500 will engage a forward wall 540' of arm 532', which is positioned at angle Θ relative to the surface—here, greater than about 225° to less than about 270°. This orientation allows the ball to be received by the wall located between two adjacent arms.

FIG. 22B shows the ball 500 captured by the turnstile 504 wherein arm 532' is located at the about 315° position. The arcuate walls of adjacent arms maintain the ball 500 and begin movement thereof in the direction of Arrow C.

FIG. 22C shows arm 532' in about the 0° position, wherein ball ejection has been initiated. The arm directly following arm 532' may contact the ball 500 to further urge it in the direction of Arrow C.

FIG. 22D shows arm 532' in about the 45° position with the ball 500 fully ejected from the turnstile 504 and moving in the direction of Arrow C toward the ball transport system.

FIG. 23 illustrates the situation where a ball 500 contacts a turnstile 504 in a non-ideal fashion. Here, arm 532' is at about the 225° position such that the angle of the longitudinal axis D of arm 532' generally coincides with a normal vector of the ball 500. If this should occur, the tip rollers 552 associated with the arm will slide along the outer surface of the ball, thereby preventing a ball jam between the arm and the surface 556. Further rotation of the turnstile 504 will place the next arm in a better orientation to capture the ball 500. The tip rollers 552 also push the ball away from the turnstile 504 if the angle of arm 532 is slightly less than about 225°. This functionality allows the turnstile 504 to rotate in such a fashion that the arm adjacent to arm 532' would be able to eventually capture the ball 500.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. An apparatus for collecting at least one ball comprising:

a left panel;

a right panel spaced from the left panel;

a rear panel associated with a rear end of the left panel and a rear end of the right panel;

a front panel associated with a front end of the left panel and a front end of the right panel, the front panel having a lower edge spaced from a lower edge of the left and right panel to provide a lower opening adapted to receive the at least one ball, and wherein the front panel has an upper opening generally defined by an upper edge of the front panel that is spaced from an upper edge of the left panel and an upper edge of the right panel;

an upper axle interconnected between the left panel to the right panel adjacent to an upper portion of the apparatus;

a first pulley rotatably interconnected to the upper axle;

a lower axle having a first end and a second end interconnected between the left panel to the right panel adjacent to a lower portion of the apparatus;

a second pulley rotatably interconnected to the lower axle;

a right wheel positioned adjacent to the right panel, the right wheel interconnected to the first end of the lower axle;

a left wheel positioned adjacent to the left panel, the left wheel interconnected to the second end of the lower axle;

a ball transport belt comprised of a plurality of segments that have a generally smooth outer surface and an inner surface having a plurality of first teeth that operatively engage the first pulley and the second pulley, wherein the first pulley and the second pulley employ second teeth that selectively engage the first teeth such that rotation of the second pulley moves the ball transport belt around the first pulley and the second pulley, wherein each segment of the plurality thereof has a first tab at a first end and a second tab at a second end, and wherein the second tab of each segment is engaged to the first tab of an adjacent segment of the plurality of segments;

a plurality of ball transferring members extending from an outer surface of the ball transport belt, wherein the engaged tabs are secured within a channel provided in each of the plurality of ball transferring members to interconnect the plurality of segments, and wherein the plurality of ball transferring members have leading edges that include a roller;

a left arm interconnected to a lower portion of the left panel and extending away from the front panel;

a right arm interconnected to a lower portion of the right panel and extending away from the front panel;

a turnstile shaft rotatably interconnected to the left panel and right panel or left arm and the right arm;

at least one turnstile comprising a plurality of arms interconnected to the turnstile shaft, wherein each arm comprises arcuate walls that meet at a tip that includes a roller, and wherein rotation of the turnstile shaft rotates the at least one turnstile;

at least one ball guide interconnected to the turnstile shaft and positioned adjacent to the at least one turnstile, wherein the at least one ball guide comprises a first ball guide and a second ball guide that do not rotate when the turnstile shaft rotates, wherein the at least one turnstile is located between the first ball guide and the second ball guide, and wherein a distance between the first ball guide and the second ball guide is configured to generally correspond to an outer diameter of the balls being collected;

wherein the upper opening is adapted to selectively receive a basket that receives collected balls;

a ball scoop located adjacent to the second pulley opposite the lower opening;

a first timing gear interconnected to the lower axle or the second pulley;

a second timing gear interconnected to the turnstile shaft;

a timing belt operatively interconnecting the first timing gear to the second timing gear, wherein rotation of the first timing gear rotates the second timing gear; and wherein the apparatus does not employ an engine or a motor and is powered only by human energy, wherein rotation of the left wheel or the right wheel rotates the second pulley to move the ball transport belt and rotate the first timing gear to move the timing belt, thereby rotating the second timing gear, which rotates the turnstile shaft and the at least one turnstile as the ball transport belt moves the plurality of ball transferring members, wherein the arcuate walls of the at least one turnstile are adapted to engage the at least one ball as the apparatus moves forward, wherein the at least one ball is then transferred by the at least one turnstile to a ball transferring member of the plurality thereof that is adapted to move the at least one ball from the lower opening to the upper opening as the apparatus is moved forward.

2. The apparatus of claim 1, further comprising at least one of a handle associated with an upper surface of the apparatus, a storage area integrated into the upper surface, a water bottle holder associated with the upper surface, and a writing surface associated with the upper surface.

3. The apparatus of claim 1, further comprising a basket adapted to receive collected balls, the basket employing selectively movable handles configured to position a lower surface of the basket away from a surface on which the at least one ball resides.

4. An apparatus for collecting at least one ball comprising:

a housing having a left side, a right side, a front side, and a rear side, the front side having a lower opening adapted to receive the at least one ball and an upper opening;

an upper axle interconnected between the left side and the right side adjacent to an upper portion of the apparatus;

a first pulley rotatably interconnected to the upper axle;

a lower axle having a first end and a second end extending between the left side and the right side adjacent to a lower portion of the apparatus;

a second pulley rotatably interconnected to the lower axle;

a right wheel positioned adjacent to the right side, the right wheel interconnected to the first end of the lower axle;

a left wheel positioned adjacent to the left side, the left wheel interconnected to the second end of the lower axle;

a ball transport belt comprised of a plurality of segments that have a generally smooth outer surface and an inner surface having a plurality of teeth that operatively engage the first pulley and the second pulley, wherein rotation of the second pulley moves the ball transport belt around the first pulley and the second pulley, wherein each segment of the plurality thereof has a first tab at a first end and a second tab at a second end, and wherein the second tab of a segment is engaged to the first tab of an adjacent segment;

a plurality of ball transferring members extending from an outer surface of the ball transport belt, wherein the engaged tabs are secured within a channel provided in each of the plurality of ball transferring members to interconnect the plurality of segments, wherein each of the plurality of ball transferring members comprise a curved upper surface spaced from a lower surface that meet at a curved end that is positioned opposite from the channel;

a left arm interconnected to a lower portion of the left side and extending away from the front side;

a right arm interconnected to a lower portion of the right side and extending away from the front side;

a turnstile shaft associated with the left side and right side or left arm and the right arm;

at least one turnstile comprising a plurality of arms interconnected to the turnstile shaft, wherein each arm comprises arcuate walls that meet at a tip that includes a roller;

at least one ball guide interconnected to the turnstile shaft and positioned adjacent to the at least one turnstile, wherein the at least one ball guide comprises a first ball guide and a second ball guide that do not rotate when the turnstile shaft rotates, wherein the at least one turnstile is located between the first ball guide and the second ball guide;

a ball scoop located adjacent to the second pulley opposite the lower opening, the ball scoop having a leading edge with a roller;

a first timing gear interconnected to the lower axle or the second pulley;

a second timing gear interconnected to the turnstile shaft; and a timing belt operatively interconnecting the first timing gear to the second timing gear, wherein rotation of the first timing gear rotates the second timing gear;

wherein rotation of the left wheel or the right wheel rotates the second pulley to move the ball transport belt and rotate the first timing gear to move the timing belt, thereby rotating the second timing gear, which rotates the turnstile shaft and the at least one turnstile as the ball transport belt moves the plurality of ball transferring members, wherein the arcuate walls of the at least one turnstile are adapted to engage the at least one ball as the apparatus moves forward, wherein the at least one ball is then transferred by the at least one turnstile to a ball transferring member of the plurality thereof that is adapted to move the at least one ball from the lower opening to the upper opening as the apparatus is moved forward.

5. The apparatus of claim 4, wherein the upper opening is adapted to selectively receive a basket that receives collected balls.

* * * * *